US005372083A

United States Patent [19]

Hattori

[11] Patent Number: 5,372,083

[45] Date of Patent: Dec. 13, 1994

[54] WATERCRAFT

[75] Inventor: Toshiyuki Hattori, Iwata, Japan

[73] Assignee: Yamaha Hatsudoki Kabushiki Kaisha, Iwata, Japan

[21] Appl. No.: 58,391

[22] Filed: May 10, 1993

Related U.S. Application Data

[62] Division of Ser. No. 857,624, Mar. 25, 1992, Pat. No. 5,255,625.

[30] Foreign Application Priority Data

| | | | |
|---|---|---|---|
| Mar. 26, 1991 | [JP] | Japan | 3-087803 |
| Apr. 11, 1991 | [JP] | Japan | 3-108587 |
| Jun. 5, 1991 | [JP] | Japan | 3-162035 |
| Sep. 30, 1991 | [JP] | Japan | 3-251565 |

[51] Int. Cl.[5] ..... B63B 21/56

[52] U.S. Cl. ..... 114/248; 114/270

[58] Field of Search ..... 114/248, 249, 270, 352

[56] References Cited

U.S. PATENT DOCUMENTS

| | | | |
|---|---|---|---|
| 3,347,201 | 10/1967 | Szabo . | |
| 3,837,315 | 9/1974 | Giblon | 114/248 |
| 3,858,541 | 1/1975 | Metcalf . | |

FOREIGN PATENT DOCUMENTS

| | | | |
|---|---|---|---|
| 63-119198 | 8/1988 | Japan . | |
| 28088 | 1/1990 | Japan | 114/352 |
| 2046689 | 11/1980 | United Kingdom . | |

*Primary Examiner*—Jesus D. Sotelo

*Attorney, Agent, or Firm*—Knobbe, Martens, Olson & Bear

[57] ABSTRACT

A number of embodiments of watercraft of the type having a main hull which is generally devoid of any independent power unit and which defines a berthing area that is adapted to receive a smaller jet propelled watercraft for propelling the main hull. The berthing area of the main hull is defined by an opening that registers with the opening of the jet propulsion unit of the smaller watercraft in such a way so as to avoid turbulence. The lower wall and the smaller watercraft hull have complimentary configurations so as to assure good support but in one embodiment a plurality of smaller openings are provided so as to permit water to enter any voids and avoid cavitation of the smaller watercraft's jet propulsion unit in operation. A combined ladder and hold down assembly is also disclosed for holding the smaller watercraft in the berthing area and for facilitating boarding of the main hull.

17 Claims, 32 Drawing Sheets

WATERCRAFT

This is a division of U.S. patent application Ser. No. 857,624, filed Mar. 25, 1992, entitled "Watercraft", now U.S. Pat. No. 5,255,625, issued Oct. 26, 1993.

BACKGROUND OF THE INVENTION

This invention relates to a watercraft and more particularly to an improved watercraft of a type that does not have its own propulsion unit and which is formed with a berthing area that is adapted to receive a smaller propelled watercraft and be propelled by that watercraft.

There is disclosed in the co-pending application entitled "Watercraft", Serial No. 722,599, filed Jun. 27, 1991 in which I am a co-inventor with Noboru Kobayashi, which application is assigned to the Assignee hereof, a type of watercraft as has generally described in the proceeding paragraph. This type of watercraft provides a large un-propelled hull that has a rider's area that is adapted to seat a large number of passengers. The watercraft is formed with a berthing area into which a smaller watercraft, normally one of the jet propelled type, is adapted to be positioned and which permits the larger hull to be powered by this small watercraft. The seating and control arrangement of the larger watercraft is such that the watercraft may be controlled by operating the controls of the smaller watercraft. There are a number of advantages to this type of watercraft, as described in the aforenoted co-pending application and this application relates to several improvements in that type of watercraft.

As disclosed in the aforenoted co-pending application, a berthing area is provided at the rear central portion of the main hull into which a smaller jet propelled watercraft is docked for propelling the larger un-powered hull. The berthing area is defined in all embodiments of that application by a lower wall in which an opening is formed which opening registers with the water inlet opening of the jet propulsion unit of the smaller watercraft so that the smaller watercraft can power the larger watercraft. As also is disclosed in that application, it is extremely desireable to provide a good seal between the water inlet opening of the lower wall of the main hull and that of the smaller watercraft to insure good efficiency of the propulsion unit.

However, the use of complimentary openings in the lower wall of the main hull and in the small watercraft is not always the most desirable mode of operation. One reason for this is that in many instances different types or different configurations of small watercraft may be placed into the berthing area for powering the larger un-powered hull. In addition, even if the small type of small watercraft is always employed, it will not necessarily insure that the openings in the bottom of the smaller watercraft and in the lower wall will be fully aligned due to docketing differences and also manufacturing variations.

It is, therefore, a principal object to this invention to provide an improved watercraft of this type wherein the opening in the lower wall of the main hull is such that it will cooperate with any of a variety of small watercraft and will insure efficient operation.

As should be somewhat apparent, one way to avoid the difficulties afore referred to is to provide a larger opening in the lower wall of the larger un-powered watercraft. By employing such a larger opening, it will be insured that the smaller watercraft water inlet opening will always register with the opening in the lower wall of the larger un-powered watercraft's berthing area. However, the use of such different size openings presents a number of disadvantages of their own.

For example, when the opening in the lower wall of the berthing area is larger than that of the small watercraft then turbulence may be generated by the water flowing into the jet propulsion unit water inlet opening. This turbulence will adversely affect the efficiency of the smaller watercraft's jet propulsion unit.

It is, therefore, a further object to this invention to provide a water inlet opening configuration in the berthing area of the larger hull that will cooperate with the water inlet opening of the smaller powering watercraft without decreasing the efficiency of the operation of the smaller watercraft.

In conjunction with the configuration of the lower wall of the larger watercraft berthing area and the bottom of the hull of the smaller watercraft, it is important to insure good sealing around the smaller watercraft's lower water inlet opening, as aforenoted. However, even if this area is effectively sealed if other facing areas between the two hulls have uneven configurations and open up air voids, the air in these voids can cause problems and inefficient operation of the jet propulsion unit. Furthermore, it is frequently desirable to configure the underside of the hull of a smaller watercraft with chines or stripes so as to improve the handling of the smaller watercraft. If the larger watercraft lower wall is not complimentary in configuration, the aforenoted problems may exist.

It is, therefore, a still further object to this invention to provide an improved cooperating configuration between the lower wall of the berthing area of the main hull and the underside of the hull of a smaller, powering watercraft.

In the aforenoted co-pending application there are disclosed embodiments that employ winches for pulling the small watercraft into the berthing area of the larger un-powered hull. Although this has some advantages, it may be in many instances be more desirable to provide a simpler configuration without incorporating such a winching arrangement. However, it is also desirable to permit the rider to pull the smaller watercraft into the berthing area without driving it in under power to avoid damaging the hulls of either watercraft.

It is, therefore, a further object to this invention to provide an arrangement which will facilitate a rider in manually moving the smaller watercraft into the berthing area.

It is another object to this invention to provide an arrangement for assisting the rider on the smaller watercraft to draw it into the berthing area without necessitating a winch or the like.

In connection with the mating surfaces between the underside of the hull of the smaller watercraft and the lower wall of the berthing area, it is not always necessary or desirable to provide a close fit in all adjacent areas. However, if there are voids when the two watercraft are joined together air may be trapped in these voids and adversely effect the efficiency of the jet propulsion unit of the smaller watercraft, as aforenoted.

It is, therefore, a still further object to this invention to provide an improved arrangement for the hull configuration of the berthing area that will avoid air being trapped between the lower wall and the hull of the smaller watercraft.

The importance of providing good sealing around the water inlet opening of the smaller watercraft's jet propulsion unit and the berthing area have already been noted. In the aforenoted co-pending application, various hold down arrangements have been described that permit the small watercraft to be held securely into contact with the opening in the lower wall of the main hull. However, the provision of such additional hold downs can incumber the watercraft and add unnecessarily to its expense.

It is, therefore, a still further object to this invention to provide an improved hold down device for a watercraft of this general type.

It is another object of this invention to provide a boarding ladder for a watercraft of this type, which boarding ladder also functions as a hold down for the small watercraft when in the berthing area.

It has been previously noted that it is desirable or, at times, occurs that different small watercraft may be positioned in the berthing area of the larger un-powered hull. There are a number of advantages in being able to accommodate different types of small watercraft in the main hull. However, it is also important to have the small watercraft firmly held in place in the berthing area when it is employed to power the main hull. Any clearances can cause vibrations and other disadvantages result.

It is, therefore, a still further object to this invention to provide an improved arrangement for improving the ability of the main hull to accommodate a wide variety of smaller watercraft and yet hold them firmly in position.

SUMMARY OF THE INVENTION

A number of features of the invention are adapted to be embodied in a watercraft that is comprised of a main hull that defines a berthing area opening at the rear end thereof for receiving a smaller watercraft having a propulsion device. The berthing area is defined by an opening in the transom of the main hull, a front wall confronting the bow of the small watercraft, a pair of facing side walls facing the side walls of the small watercraft and a lower wall on which the hull of the small watercraft is supported when in the berthing area.

In accordance with a first feature of the invention, the smaller watercraft propulsion device comprises a jet propulsion unit having a downwardly facing water inlet opening formed in its lower hull and substantially rearwardly of the bow and through which water is drawn for the propulsion of the smaller watercraft and for powering the main hull when the smaller watercraft is in the berthing area. A water inlet opening is formed at least in part by a trailing edge of the lower wall of the main hull and extends from the point substantially aft of the front wall and substantially forwardly of the water inlet opening of the smaller watercraft when in the berthing area for drawing water into the smaller watercraft water inlet opening and reducing turbulence in the water so drawn into the water inlet opening.

In accordance with another feature of the invention, the lower surface of the hull of the small watercraft is configured to form at least one surface discontinuity extending in a longitudinal direction. The lower wall is formed with a portion of complimentary configuration to the hull lower surface for providing a surface to surface contact between the lower wall and the lower surface of the smaller watercraft hull when the smaller watercraft is received in the berthing area.

In accordance with another feature of the invention, the main hull is provided with a plurality of longitudinally spaced head grips along the sides of the berthing area for facilitating the drawing of the smaller watercraft into the berthing area by a rider sitting in the smaller watercraft.

In accordance with another feature of the invention, the lower wall forms at least a portion of a water inlet opening that registers with a water inlet opening of a jet propulsion unit which forms the powering device of the smaller watercraft when the smaller watercraft is in the berthing area. In addition, another hole is foraged in the lower wall in forward location so as to reduce the liklihood of air being trapped between the lower wall and the smaller watercraft when the smaller watercraft is received in the berthing area.

In accordance with yet another feature of the invention, at least one of the side and front walls of the main hull is adapted to support removal pads for accommodating different sized and configured small watercraft in the berthing area.

A further feature of the invention is adapted to be embodied in a watercraft that is comprised of a mail hull having a berthing area open at the rear end thereof for receiving a smaller watercraft having a propulsion device. The berthing area is defined by an opening in the transom of the main hull through the which the smaller watercraft may be positioned for entry into the berthing area. A ladder is supported for movement by the main hull between a lowered position for permitting entry of the mail hull from the body of water in which the watercraft is operating and a raised out-of-the water position. In at least one of these positions, the ladder has a portion that is adapted to engage the small watercraft and restrain it in the berthing area.

DETAILED DESCRIPTION OF THE PREFERRED EMBODIMENTS OF THE INVENTION

Figure 1:
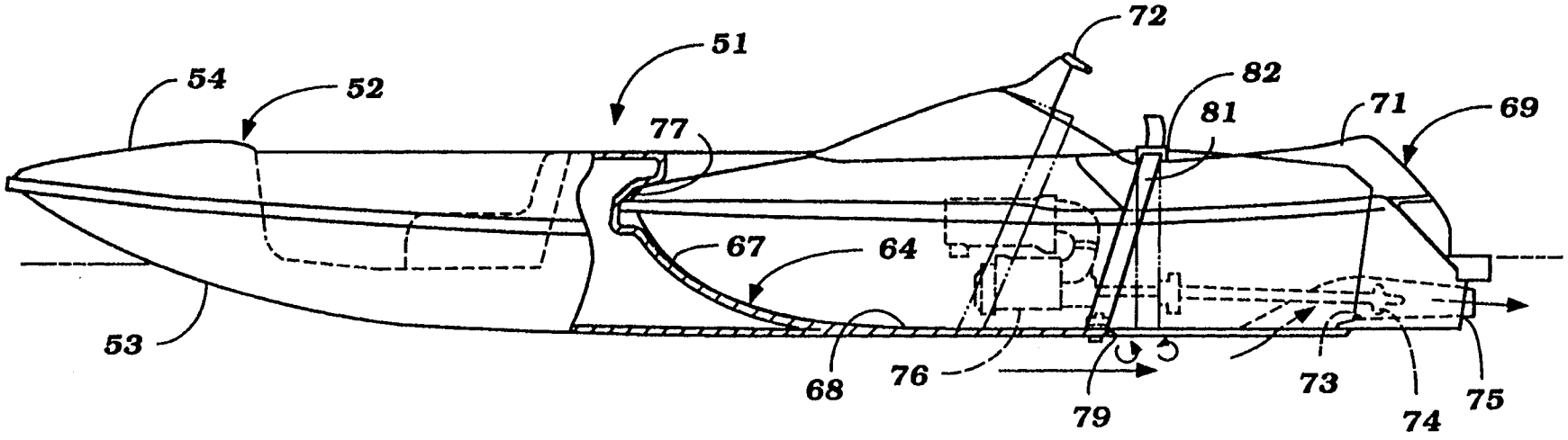
FIG. 1 is a side elevational view of a watercraft constructed in accordance with a first embodiment of the invention, with a portion broken away.

Referring first to the embodiment of FIGS. 1 through 4, a watercraft constructed in accordance with this embodiment is identified generally by the reference numeral 51. The watercraft 51 is comprised of a main hull portion, indicated generally by the reference numeral 52 which is comprised of a lower hull member 53 and an upper deck member 54, which members 53 and 54 may be conveniently formed from any suitable materials such as a fiberglass reinforced resin or the like. A characteristic of the main hull 52 is that it is devoid of any propulsion system of its own. The manner in which the main hull 52 is propelled will be described latter.

The deck portion 54 provides a rider's area, indicated generally by the reference numeral 55 and which in top plan view has a generally U-shaped configuration. At the front thereof, in this embodiment, there are provided three seats 56, 57 and 58 each having its own respective seat back.

Rearwardly of the transversely extending front portion, there are provided a pair of side portions each of which has a respective rearwardly facing seat 59 and 61 to the back of the seats 56 and 58 and rearwardly positioned, forwardly facing seats 62 and 63, respectively. Hence, the rider's area 55 in this embodiment affords seating for at least seven passengers.

Between the rear seating areas containing the seats 59, 62 and 61, 63 the hull is provided with a berthing area, indicated generally by the reference numeral 64. This berthing area 64 is defined by a pair of side walls 65 and 66, a front wall 67 and a bottom wall 68. In this embodiment, the bottom wall 68 is formed generally integrally with the front wall 67 but it is to be understood that other configurations may be employed and other types of constructions may be utilized.

A small watercraft, indicated generally by the reference numeral 69 is adapted to be docked and retained in the berthing area 64, in a manner will be described. The small watercraft 69 is, in this embodiment, of the jet propelled type and provides a single centrally positioned seat 71 that is adapted to accommodate one or more riders seated in straddle fashion. A control 72 is provided forwardly of the seat 71 and includes a handle bar for steering the small watercraft 69, in a manner to be described, and also a throttle control mechanism (not shown).

The small watercraft 69 is powered by a jet propulsion unit which is mounted within a tunnel on its underside and which jet propulsion unit includes a downwardly facing water inlet opening 73 that is formed in the underside of the hull of the small watercraft 69. An impeller 74 draws water through the water inlet opening 73 and discharges it through a discharge nozzle 75 for propelling the small watercraft 69 in a well known manner. A steering nozzle (not shown) is pivotally mounted in registry with the discharge nozzle 75 and is steered by the handle bar assembly 72 for steering the small watercraft 69.

The jet propulsion unit and specifically the impeller 74 is driven by an internal combustion engine 76 mounted forwardly in the hull of the small watercraft 69 and which drives the impeller 74 in a well known manner.

It should be noted that the front wall 67 defines a recess 77 in which the bow of the small watercraft 69 is positioned so as to not only hold the small watercraft 69 against forward motion but also to hold its lower hull portion in engagement with the lower wall 68 of the berthing area 64.

Figure 4:
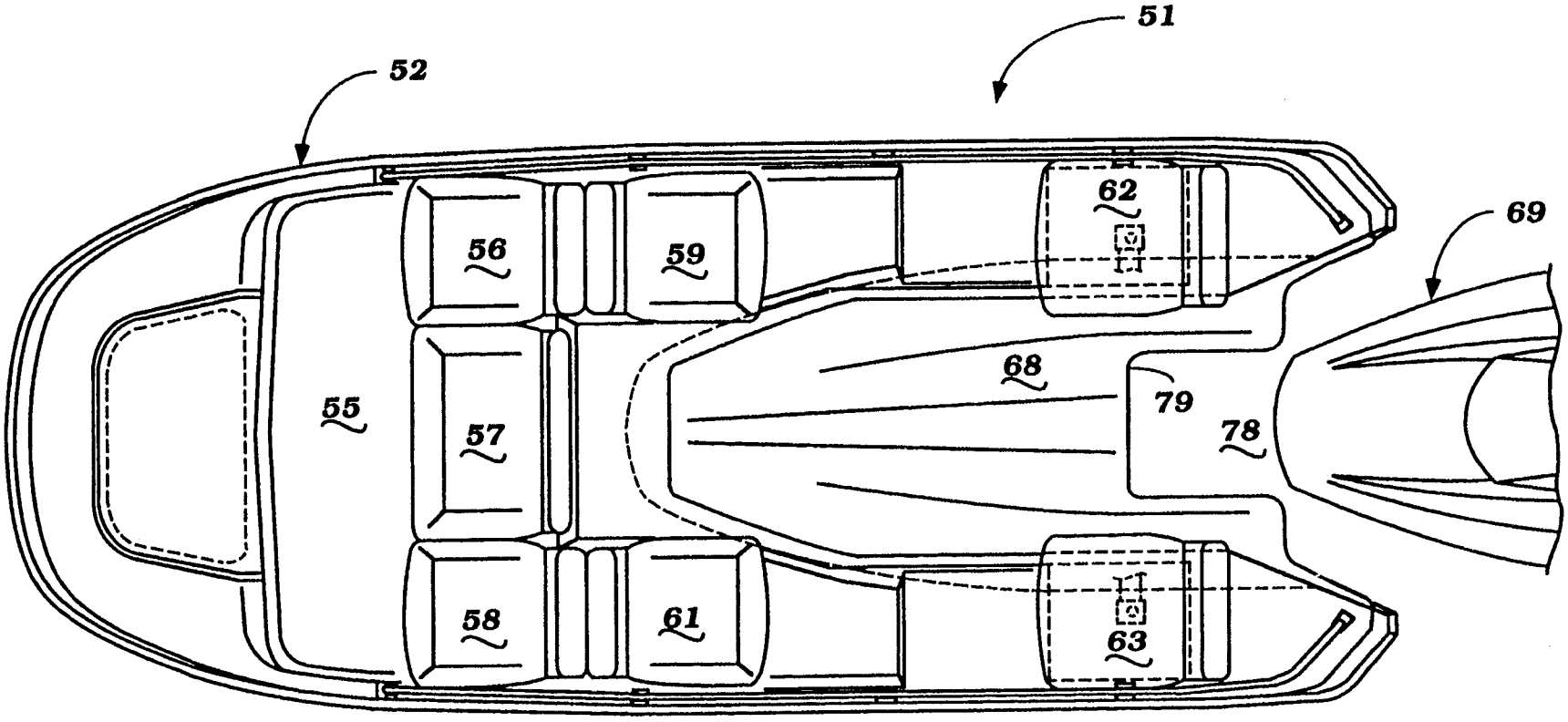
FIG. 4 is a top plan view, in part similar to FIG. 2, and shows the small watercraft approaching the berthing area of the larger main hull.

As may be best seen in FIG. 4, the lower wall 68 is formed with a water inlet opening 78 which is disposed a distance rearwardly of the front wall 67 and which opens through the transom of the hull 52. The opening 78 is disposed so that its forward edge 79 will be disposed forwardly of the forward edge of the water inlet opening 73 of the jet propulsion unit of the small watercraft 69 when the small watercraft 69 is in position within the berthing area 64. This is important for a reason which may be best understood by reference to FIG. 1. As may be seen, there will be a step formed between the rear edge 79 fo the opening and the front edge of the water inlet opening 73 of the small watercraft 69. Because of this edge, water turbulence will occur as shown by the arrows in FIG. 1. By placing the edge 79 of the opening 78 well forwardly of the forward portion of the water inlet opening 73 of the jet propulsion unit, this turbulence will have dissipated so that a smooth and laminar flow of water will enter the opening 73 of the jet propulsion unit of the small watercraft 69 to improve its efficiency.

A pair of hold down straps 81 having a buckle 82 are provided so as to hold the small watercraft 69 in position so that its water inlet opening 73 will be firmly pressed against the lower wall 68 around the opening 78 so as to avoid the possibility of any water or air leakage in this area that would adversely affect the performance of the jet propulsion unit of the small watercraft 69.

Figure 2:
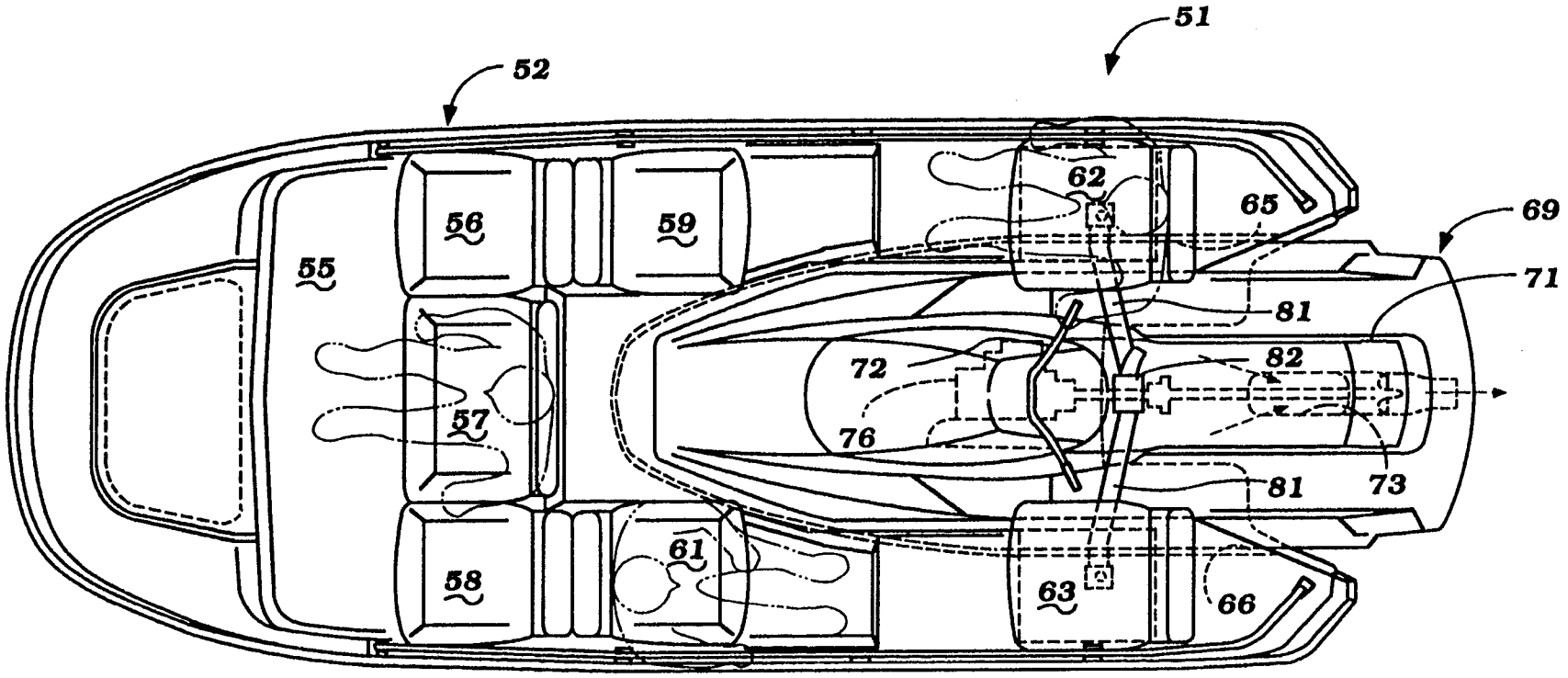
FIG. 2 is a top plan view of this embodiment.

As may be seen readily in FIG. 2, when the small watercraft 69 is docked in the berthing area 64 a rider seated in the seat 62 can easily operate the small watercraft control 72 so that the entire watercraft 51 may be powered and controlled by the propulsion and control system of the small watercraft 69. As a result of this construction, the small watercraft 69 may be utilized for sporting nature and yet a large number of passengers accommodated when it is docked in the berthing area 64 of the main hull 52. The advantages of this type of construction are further disclosed in aforenoted copending application Ser. No. 722,599, filed Jun. 27, 1991.

Figure 3:
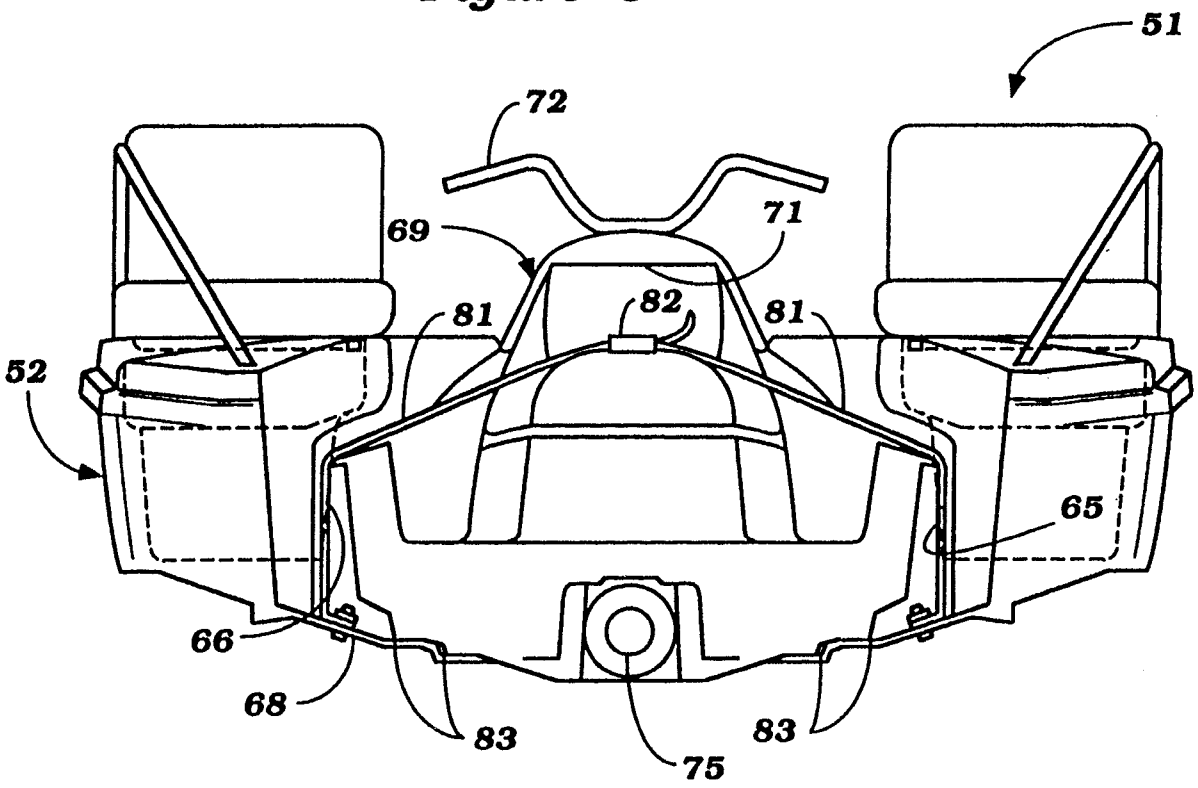
FIG. 3 is a rear elevational view of this embodiment.

As may be clearly seen in FIG. 3, the bottom of the hull of the small watercraft 69 is provided with a plurality of chines or stripes 83. In a similar manner, the lower wall 68 of the main hull 52 is like configured so as to provide good sealing engagement between the two hull portions so as to further improve the efficiency of the jet propulsion unit of the small watercraft 69 when it is being employed to power the main hull 52.

As may be readily seen from FIG. 1, the small watercraft 69 and specifically its seat 71 is disposed, when in the berthing area 64, at a level higher than the front center seat 57. Also, it should be noted that the front center seat 57 has a relatively low backrest as clearly seen in FIG. 1. As a result of this construction, a rider may sit on the small watercraft seat 71 and operate the combined watercraft assembly 51 even when a rider is seated in the front center seat 57. This is because, assuming both riders have equal stature, the head of the rider on the small watercraft 69 and specifically on its seat 71 will be above the head of the rider seated in the front center seat 57. Thus, the seat of the small watercraft 69 may be used to accommodate a still further rider and the combined watercraft 51 may be operated by this added rider.

Referring now to FIGS. 5 through 16, a watercraft constructed in accordance with a second embodiment of the invention is identified generally by the reference numeral 101. The watercraft 101 is generally similar to the watercraft 51 of the previously described embodiment. In this embodiment, however, a different form of hold down device is employed for retaining the smaller watercraft within the berthing area of the main hull and also which serves the added function of acting as an entry ladder. In addition, the smaller watercraft shown in this embodiment is of a different type than that employed in the embodiment of FIGS. 1 through 5. Also, there are some variations in the seating configuration and certain details of the watercraft construction.

The watercraft 101 includes a main hull 102 that defines a passengers' compartment 103 and a berthing area 104 which is encompassed on three sides by the passenger area 103. A small watercraft, indicated generally by the reference numeral 105 is adapted to be positioned in the berthing area 104 and retained therein in a manner which will be described.

The seating arrangement in this embodiment is somewhat different from the previously described embodiment but it is to be understood that a wide variety of seating configurations may be provided in the rider's area of any of the embodiments disclosed herein. In this embodiment, there are provided on the sides of the berthing area 104 pairs of facing seats 106, 107 and 108, 109. The front portion of the rider's area 103 is provided with a couch like configuration comprised of a pair of side seats 111 and 112 and a transversely extending front seat 113.

The berthing area 104 is provided with spaced apart side walls 114 and 115 (FIG. 8) and a front wall 116 (FIG. 5) that has a notched area 117 so as to receive the bow of the small watercraft 105 so as to hold it in position. The front wall 116 merges into a lower wall 118 which, like the previously described embodiment, is provided with a cut-out or opening 119. In this embodiment, the opening 119 does not extend to the rear of the transom but extends for a substantial length and one which is greater than the length of the opening of the jet propulsion unit of the smaller watercraft 105, as will be described hereinafter.

Figure 5:
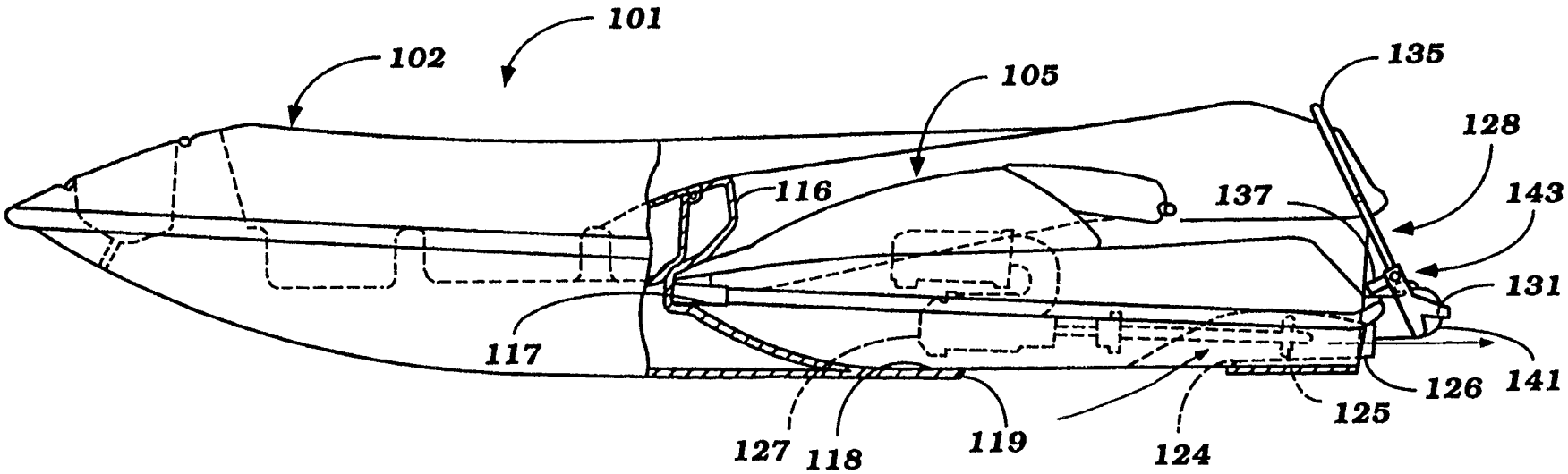
FIG. 5 is a side elevational view, in part similar to FIG. 1, with a portion broken away, showing another embodiment of the invention.
Figure 6:
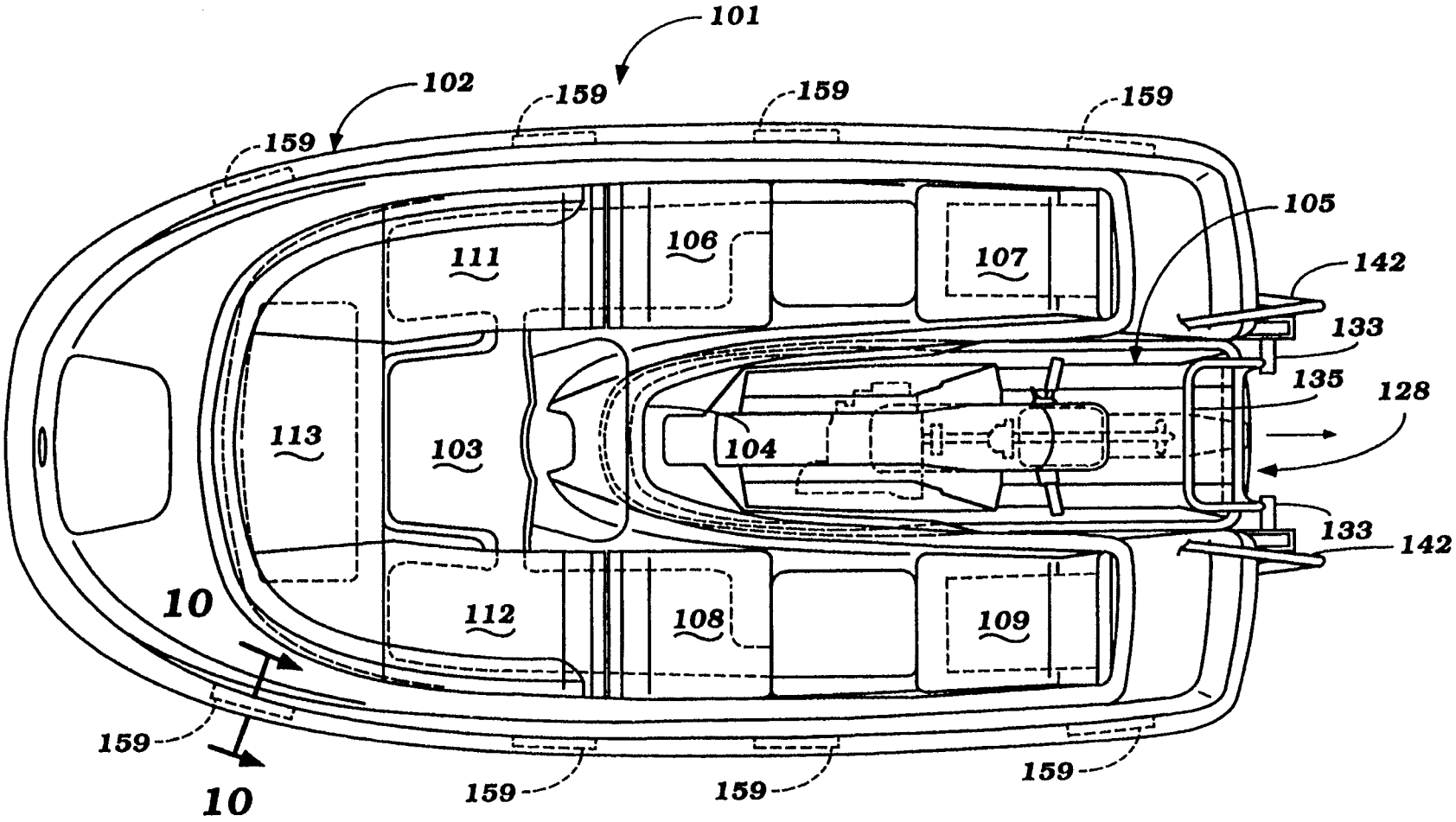
FIG. 6 is a top plan view of this embodiment.
Figure 13:
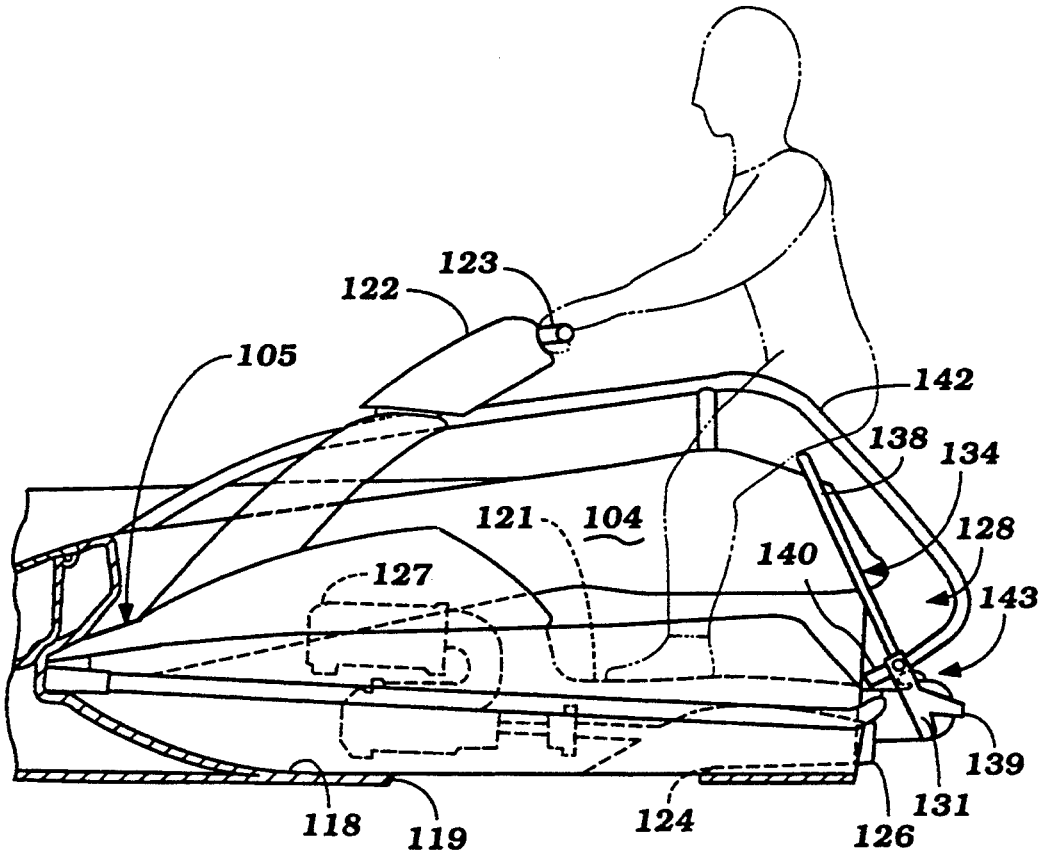
FIG. 13 is a side elevational view, with portions shown in cross section, similar to FIG. 7 but shows how a rider may propel the watercraft from the small watercraft in this embodiment.
Figure 14:
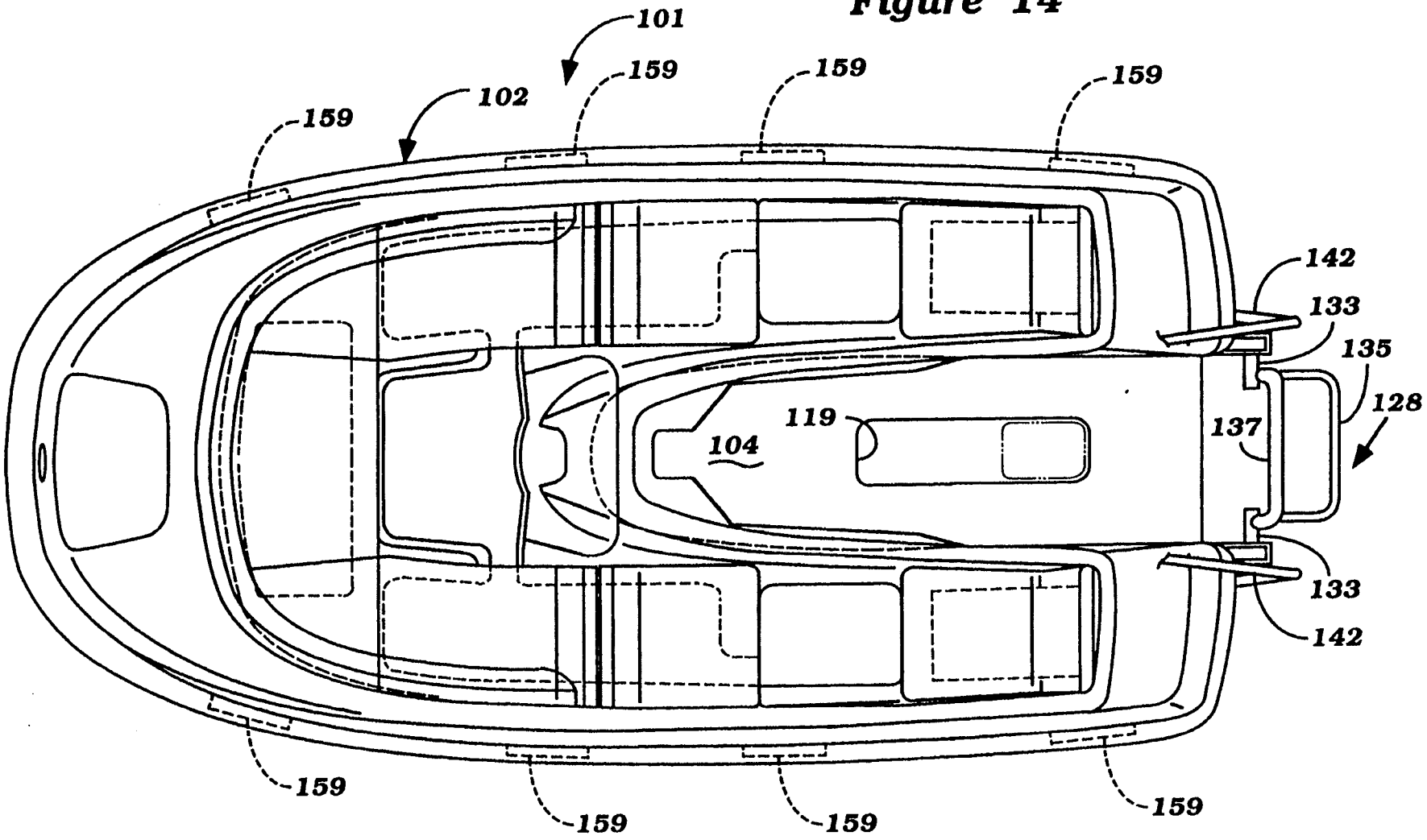
FIG. 14 is a top plan view, in part similar to FIG. 6, but shows the watercraft without a small watercraft in the berthing area.

In this embodiment, the small watercraft 105 has a rear deck 121 (FIG. 13) that is adapted to accommodate a rider either standing as shown in phantom in FIG. 13 or kneeling. A mast 122 is positioned forwardly of the deck 121 and is pivotal about a transversely extending, forward pivot axis between a lowered position as shown in FIG. 5 and a raised position as shown in FIG. 13. A handle bar 123 is carried by the mast 122 for steering of the watercraft 105. In addition, a throttle control may be mounted on the handle bar assembly 123 as is well known with this type of watercraft.

The small watercraft 105 is powered by a jet propulsion unit that includes a downwardly facing water inlet opening 124 through which water is drawn by an impeller 125. This water is then discharged through a discharge nozzle 126 which may cooperate with a steering nozzle (not shown) for powering and steering both the small watercraft 105 and the larger hull 102 when the smaller watercraft 105 is received in the berthing area 104.

An internal combustion engine 127 of any known type is positioned forwardly of jet propulsion unit and drives the impeller 125 in a known manner.

As may be readily seen in several of the figures, the jet propulsion unit water inlet opening 124 is disposed at the rear end of the lower wall opening 119 and quite a distance rearwardly of its leading edge. As a result, any turbulence induced by the step between the lower wall 119 and the lower surface of the hull of the smaller watercraft 105 will be dissipated before the water reaches the water inlet opening 124 and high efficiency will result.

Figure 8:
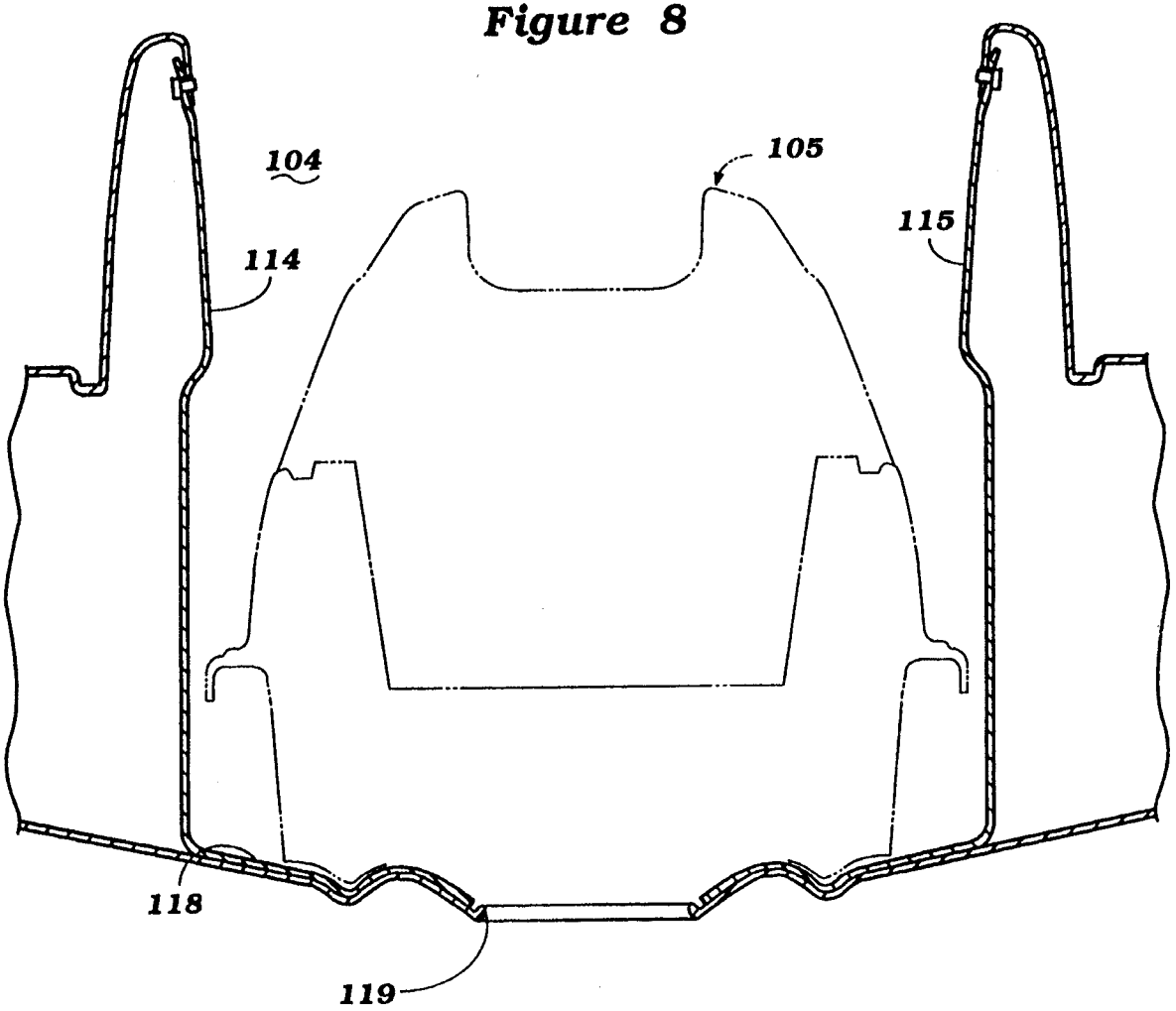
FIG. 8 is a cross sectional view taken along the line 8—8 of FIG. 7 and shows the small watercraft in phantom.
Figure 9:
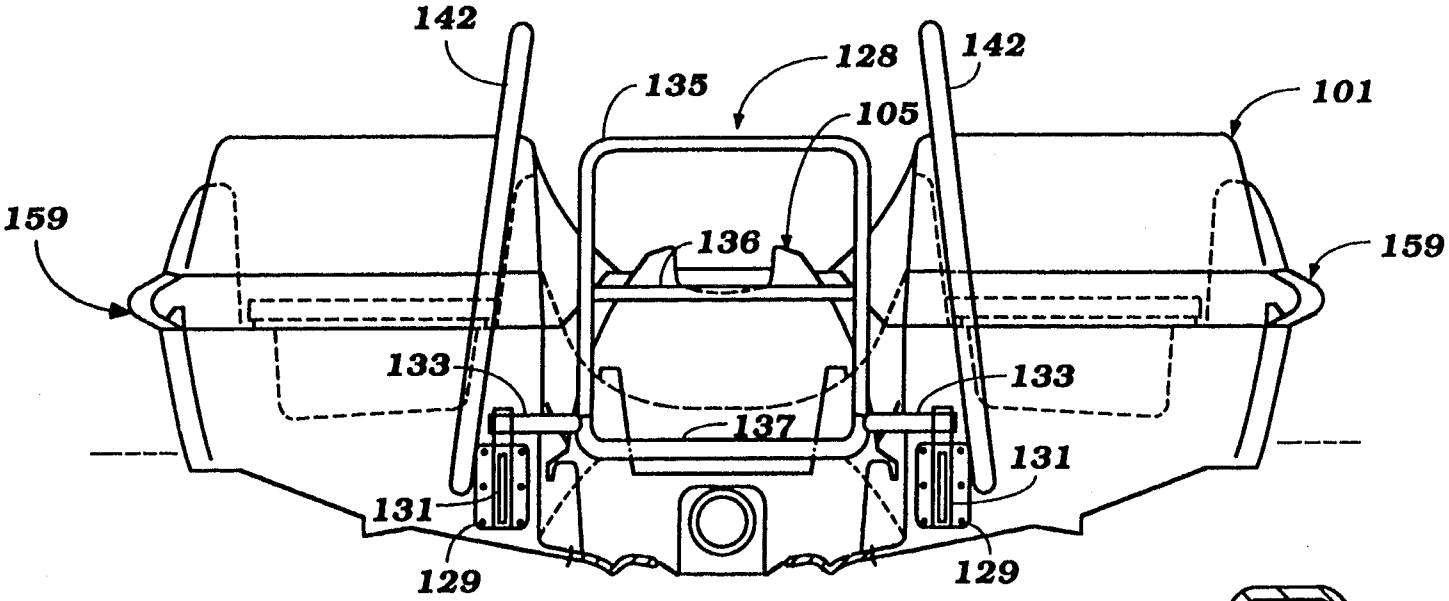
FIG. 9 is a rear elevational view of this embodiment.
Figure 10:
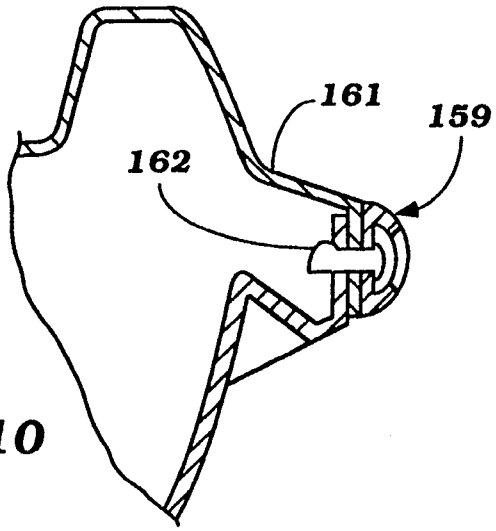
FIG. 10 is an enlarged cross sectional view taken along the line 10—10 of FIG. 6.

As may be seen in FIG. 8, the small watercraft 105 has a configured lower surface on its underside and the wall 118 is configured so as to be complimentary to it. It should be noted that in conjunction with the actual configuration of the lower portion of the hull of the small watercraft 105 around the inlet opening 124, this area is generally flat. Therefore, the lower wall 118 of the main hull berthing area 104 is also flat in this area. This will assist in providing good sealing around the water inlet opening even if the remaining adjacent surface areas of the lower hull of the small watercraft 105 and the upper surface of the lower wall 118 are not exactly mating.

Figure 7:
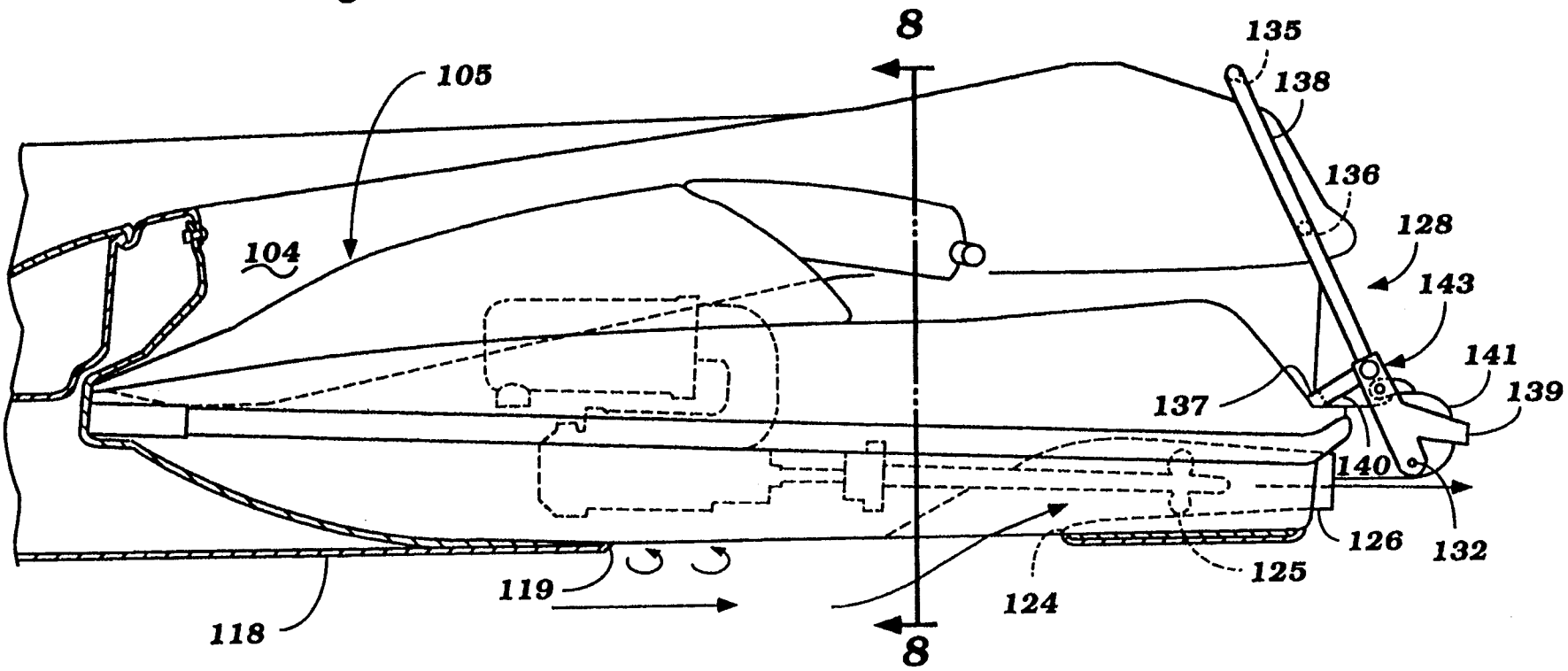
FIG. 7 is an enlarged side elevational view, with the portion broken away, of the rear portion of the watercraft to the rear of the broken line in FIG. 5.

As may be seen in FIGS. 7 and 8, the front wall 116 and side walls 114 and 115 extend in overlapping relationship in the berthing area 104 in the area of its lower wall. This overlapping relationship provides a double wall strength to further strengthen the hull of the unpowered watercraft 102 to accommodate the weight of the smaller watercraft 105. Also, this type of smaller watercraft normally is operated with the rider in a standing position as shown in FIG. 13. In this standing position, the head of a rider seated in the center of the front sat 113 and thus like the preceding embodiment, a rider operating the smaller watercraft 105 in his normal operating position will be able to operate both watercraft when they are docked together to form the assemblage 101.

It has been noted, a combined boarding ladder and hold down assembly is incorporated for holding down the rear of the small watercraft 105 when it is in the berthing area 104 and also for permitting boarding of the main hull 102 from the body of water in which it is operating. This combined assembly is identified generally by the reference numeral 128 and its construction and operation may be best understood by reference to FIGS. 11 through 13, 15 and 16.

This construction includes a pair of mounting plates 129 that are affixed in a suitable manner to the rear of the transom of the main hull 102 on opposite sides of the berthing area 104. These mounting brackets 129 each support a respective bifurcated arm 131 for pivotal movement about a pivot axis defined by respective pivot pins 132. The bifurcated arms 131 are connected, in turn, to cross ties 133 of a ladder, indicated generally by the reference numeral 134 which ladder has a generally box like configuration and is formed by a lower step 135, a mid step 136 and a combined first step and locking element 137. These steps 135, 136 and 137 are joined by side pieces 138. It should be noted that the top step locking member 137 is offset from the other steps 135 and 136 as clearly shown in FIGS. 11 and 13.

Figure 15:
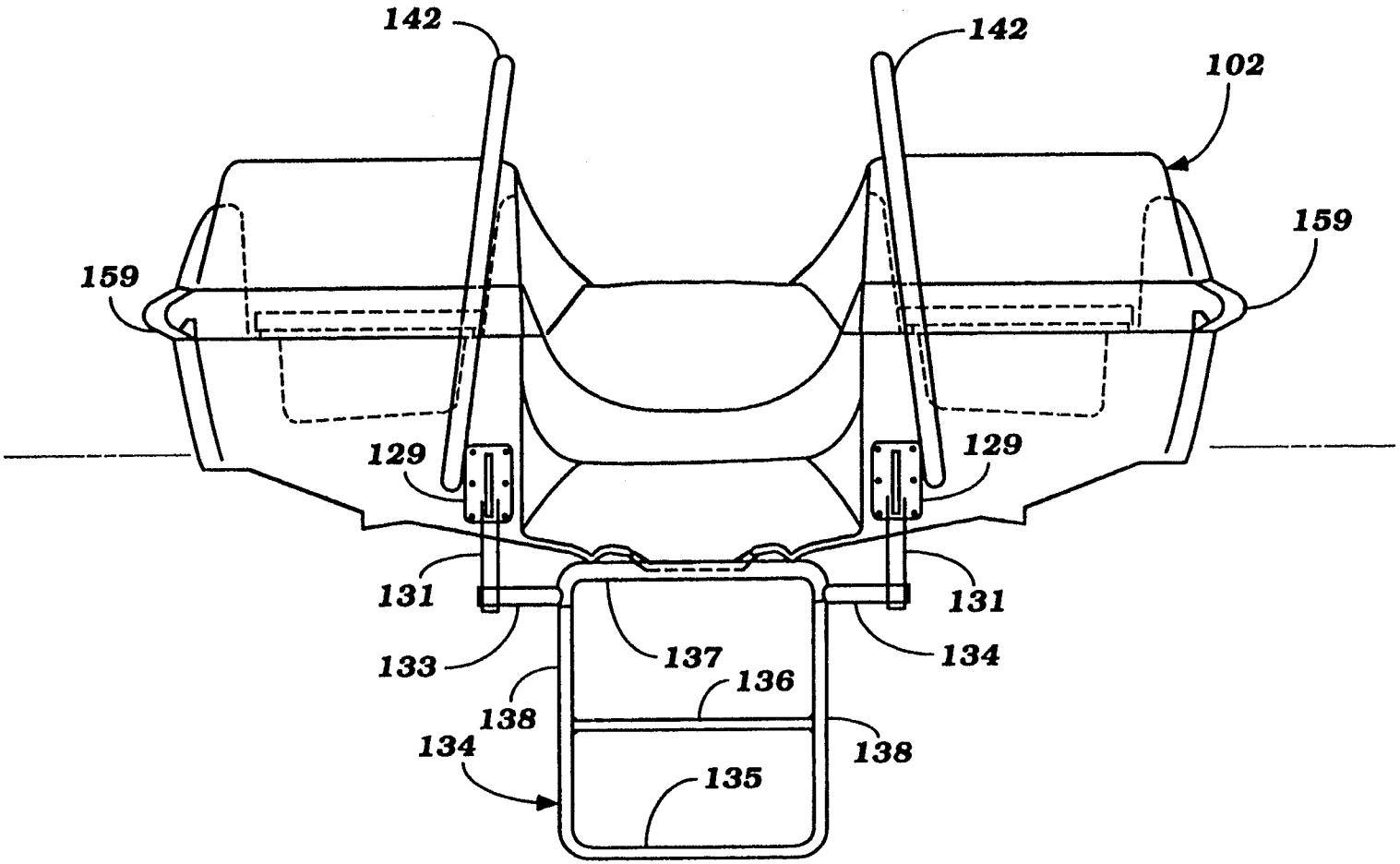
FIG. 15 is a rear elevational view, in part similar to FIG. 9, but shows the ladder in its operative position for assisting entry of the smaller watercraft or boarding of the main hull.
Figure 16:
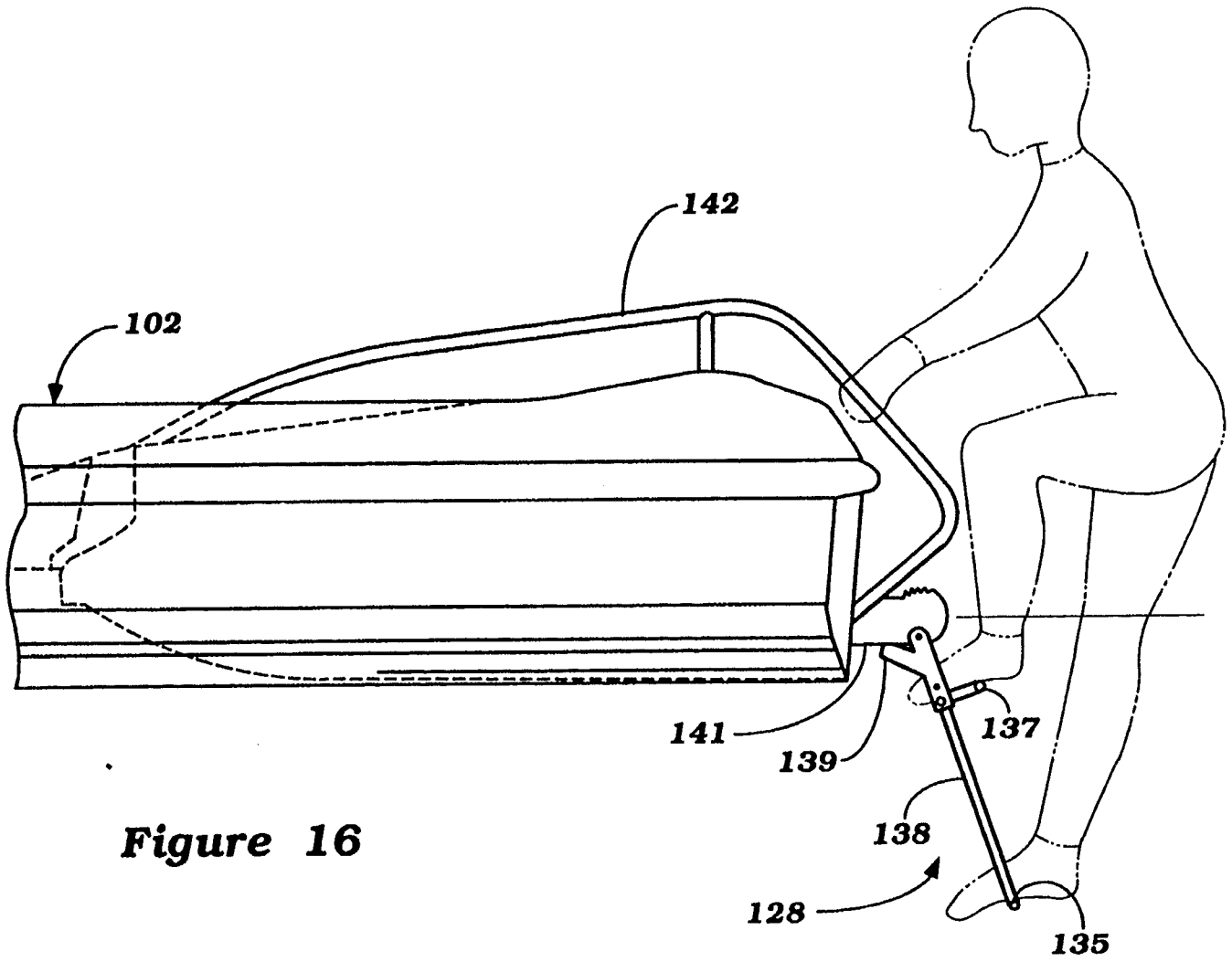
FIG. 16 is a side elevational view showing how the rider may enter the watercraft in the body in which the watercraft is operating using the boarding ladder when in the position shown in FIG. 15.
Figure 17:
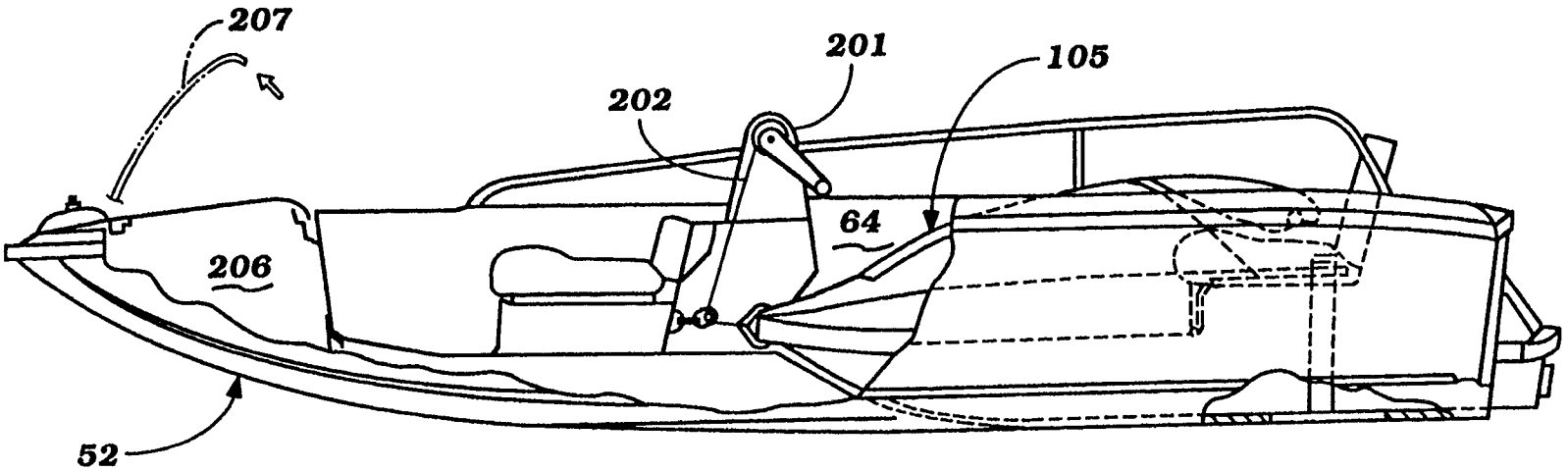
FIG. 17 is a side elevational view, in part similar to FIGS. 1 and 5, with a portion broken away, of a third embodiment of the invention.
Figure 18:
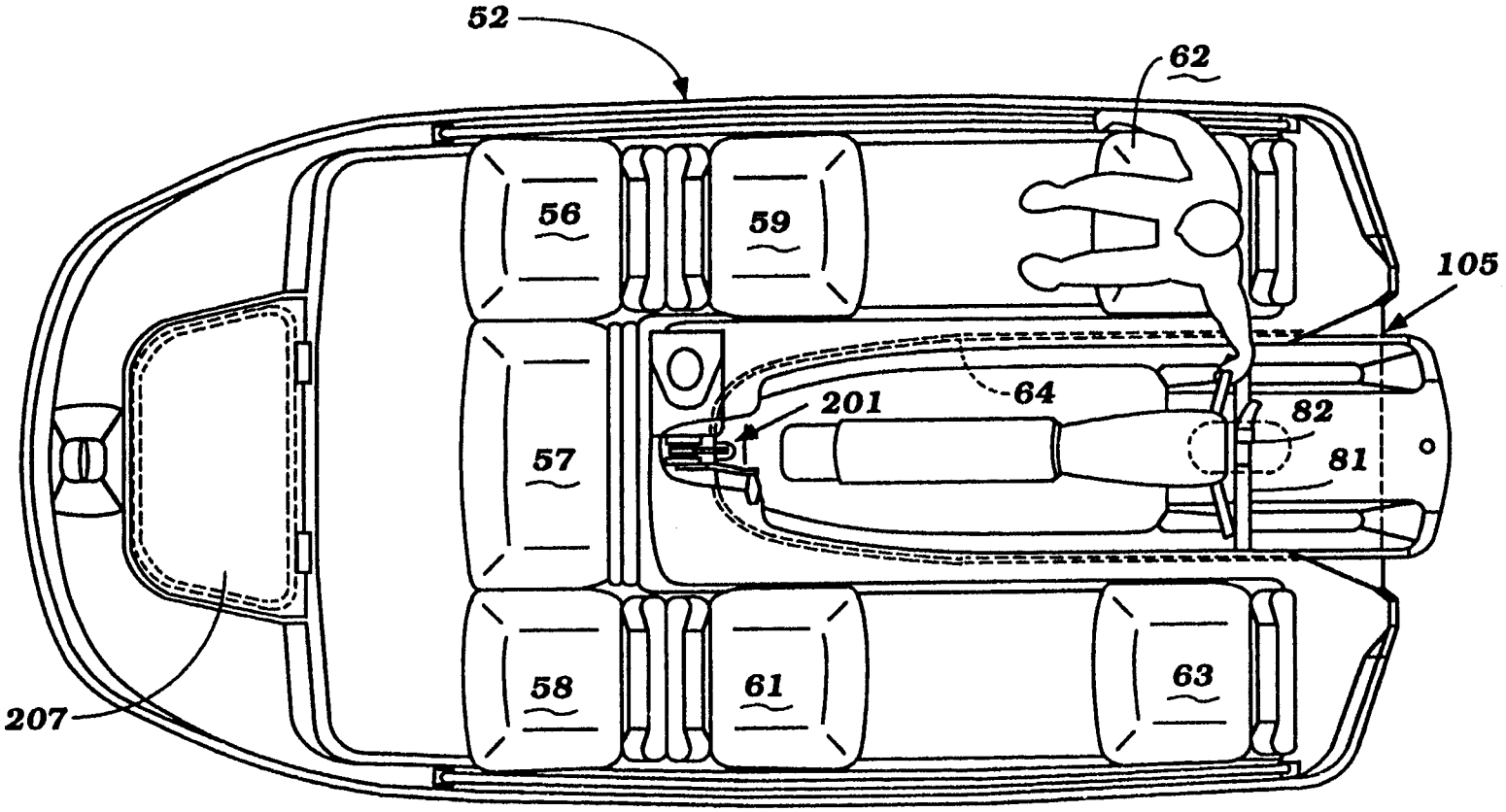
FIG. 18 is a top plan view of this embodiment.
Figure 19:
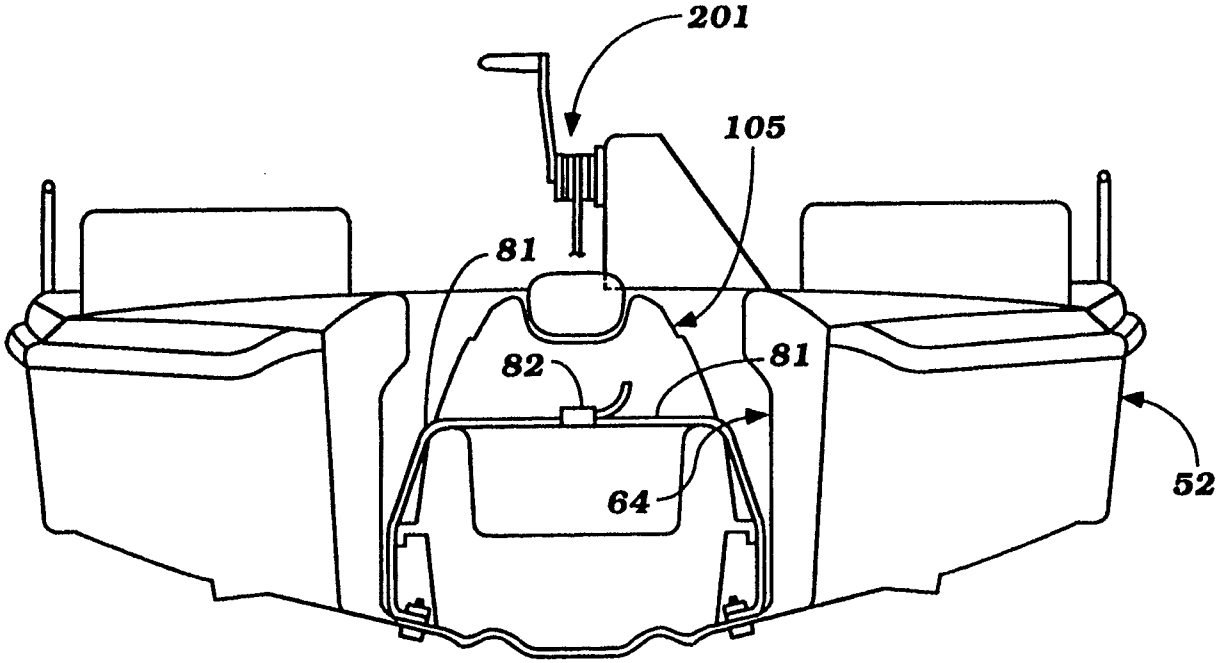
FIG. 19 is a rear elevational view of this embodiment.
Figure 20:
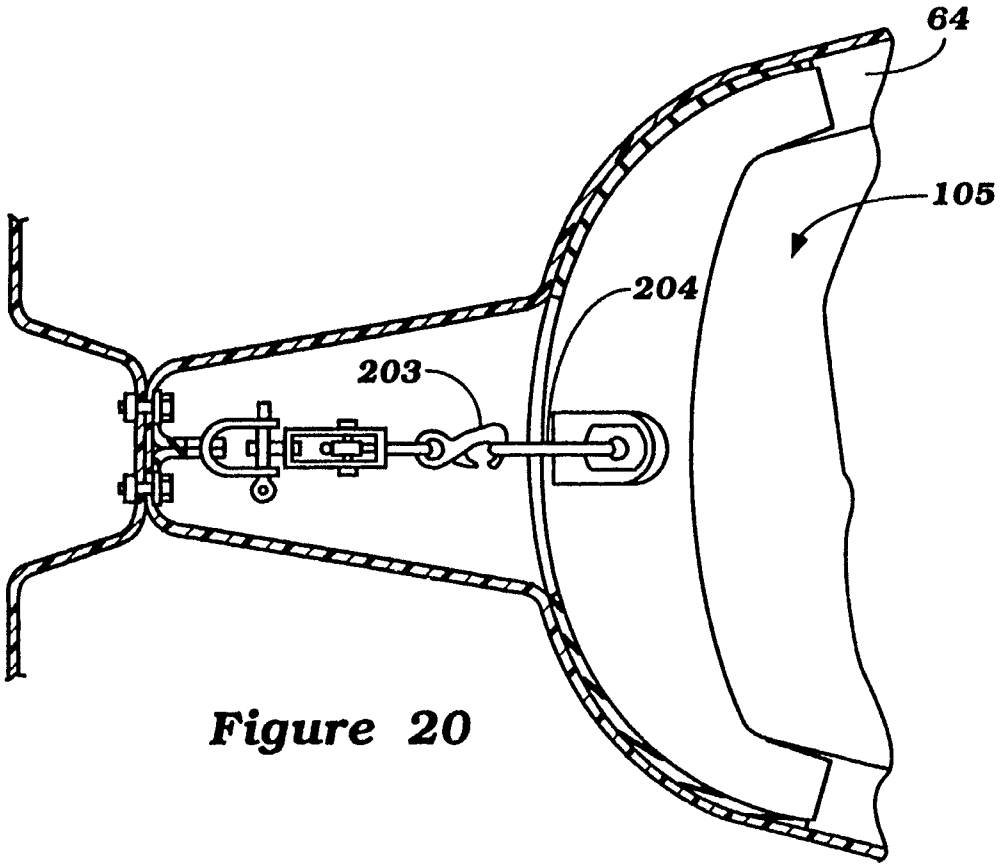
FIG. 20 is an enlarged cross sectional view, taking generally along the line 20—20 of FIG. 21 and shows how the bow of the small watercraft is retained in the berthing area.

The bifurcated members 131 have stopper portions 139 which extend on opposite sides of an outwardly extending flange 141 of the mounting brackets 129 and which engage the underside of the portion 141 which in their lowered boarding position as shown in FIGS. 15 and 16. As may be seen in FIG. 16, in this lowered position of this assembly 128, a person may easily enter the watercraft 101 from the body of water in which it is floating. A pair of side grab rails 142 are disposed on opposite sides of the berthing area 104 so as to permit ease of entry. In addition, a rider on the small watercraft 105 may use the grab rail 142 to help him pull the small watercraft 105 into the berthing area 104.

Figure 11:
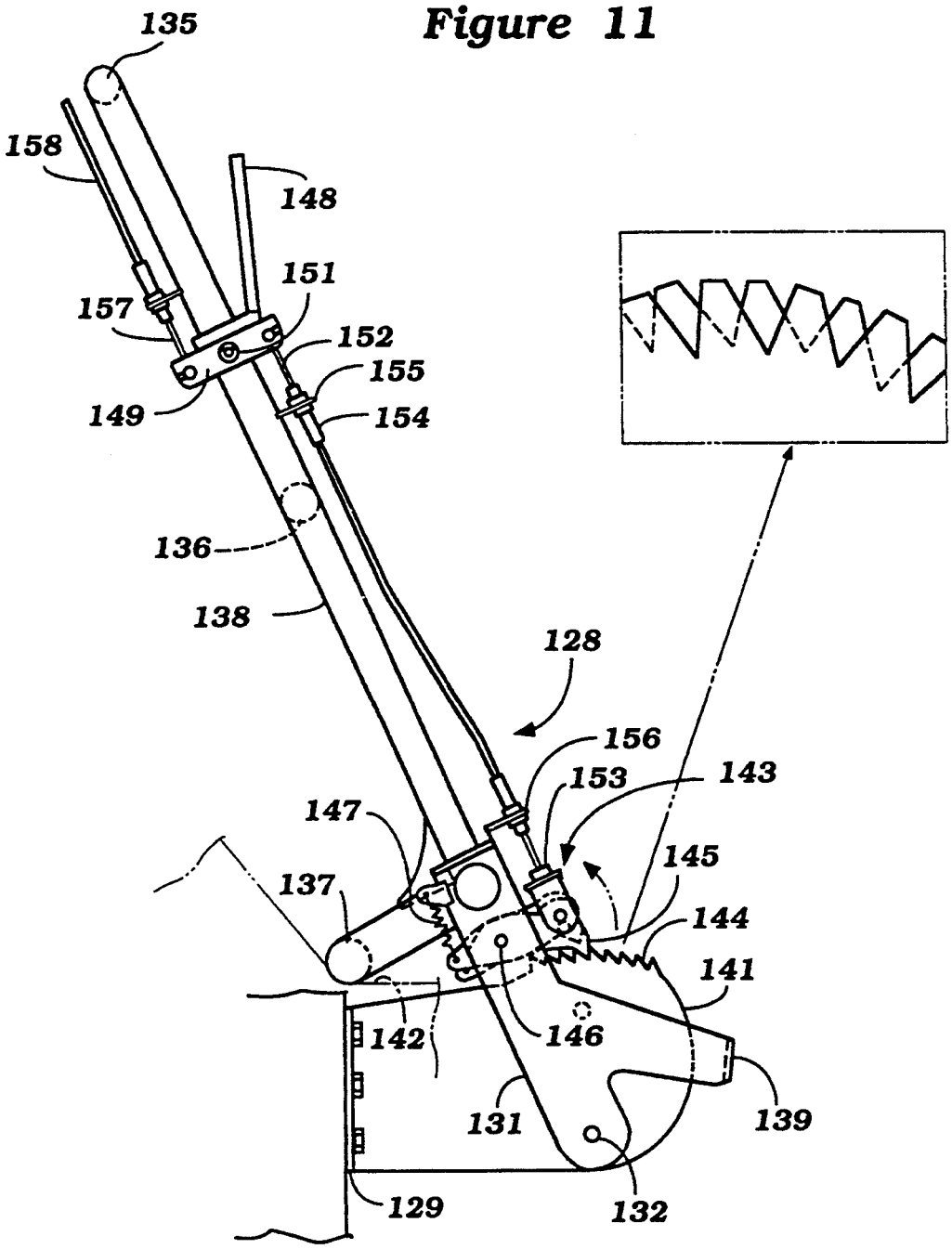
FIG. 11 is an enlarged side elevational view of the ladder and locking construction of this embodiment shown in a locking position.
Figure 12:
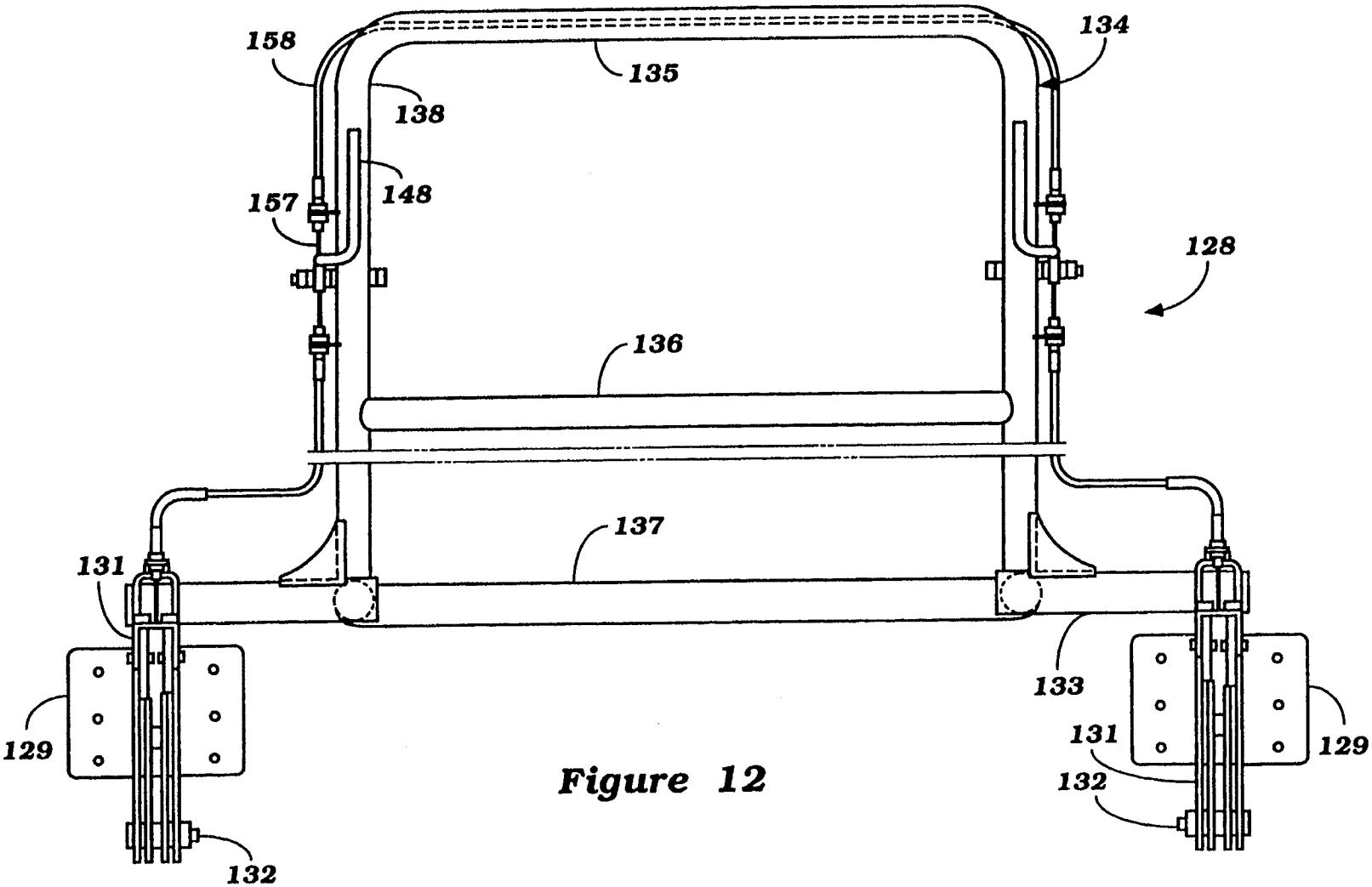
FIG. 12 is a rear elevational view of the ladder construction in its locking position.

As may be best seen in FIG. 11, although the construction also appears in certain of the other figures, when the device 128 is pivoted to its upper position, the top step, retaining member 137 will be engaged with a rear portion 140 of the deck 121 of the small watercraft 105 and will press the lower hull of the small watercraft 105 around the water inlet opening 124 into firm engagement with the lower wall 118 around its opening 119 to insure good efficiency of the jet propulsion unit of the small watercraft 105. A ratchet type locking mechanism, indicated generally by the reference numeral 143 is also provided for retaining the assemblage 128 in this upper locking position. This includes a ratchet like toothed portion 144 formed on the bracket portions 141 and a cooperating pawl 145 that is pivotally supported on the bifurcated members 131 by a pivot pin 146. A spring 147 acts against the opposite end of each pawl 145 to urge it into its engaged or locked position as shown in FIG. 11.

A release mechanism for releasing the pawls 145 and locking mechanism 143 is incorporated on one side 138 of the member 128. This includes a release handle 148 having a based portion 149 that is pivotally supported on the side member 138 by means of a pivot pin 151. One end of a bowden wire cable 152 is affixed to the portion 149 at its upper end and to the pawl 145 by a trunion member 153 at its lower end. The bowden wire 152 is enclosed within a protective sheath 154 that has its ends affixed to the side member 138 and bifurcated member 131 by respective brackets 155 and 156.

The release handle 148 has its portion 149 connected to one end of a bowden wire cable 157 which extends across the upper portion of the bottom step 135 and down the other side and is there connected to the pawl 145 of the opposite side latching mechanism so that both pawls will be operated in unison. A protective sheath 158 encircles the bowden wire actuator 157.

As may be seen from FIGS. 5 through 13, when the ladder hold down assembly 128 is in its raised locking position, the small watercraft 105 will be held securely in the berthing area 104. As may be seen in FIG. 13, if a rider stays on the small watercraft 105 when it is in the berthing area, that rider may rest on the bottom step 135 of the ladder 134 for support. When the latching assemblies 143 are released, then the ladder, hold down assembly 128 may be pivoted to its lower position as shown in FIGS. 4 through 16 to assist boarding of the watercraft 101. In addition, in this lower position the small watercraft 105 may be easily driven into the berthing area 104 and then the device 128 pivoted to its latching position to retain the small watercraft 105 in the berthing area 104.

In this embodiment of the invention, the main hull 102 is provided with a plurality of bumper assemblies, indicated at 159 which are disposed around the periphery of the main hull 102 on outwardly extending flanges 161 (FIG. 10) of the hull 102. These bumper assemblies 159 are comprised of elastomeric elements that affixed to the flange 161 by appropriate snap type fasteners 162. Such bumper assemblies may be employed on the hulls of any of the other embodiments thus far described. These bumper assemblies 159 protect the hull during docking.

FIGS. 17 through 23 show another embodiment of the invention is generally similar to the embodiment of FIGS. 1 through 5 insofar as the construction of the main hull is concerned and which is designed primarily to operate and accommodate a small watercraft of the type shown in the embodiment of FIGS. 5 through 16. Of course and as has been previously noted, any type of small watercraft may be employed with any type of main hull embodying the various features of the invention which have been and will be described. However, because of this similarity to the two previously described embodiments, the main hull and its components have been identified by the reference numerals applied to FIGS. 1 through 4 and the small watercraft and its components have been identified by the reference numerals applied to FIGS. 5 through 16.

Figure 21:
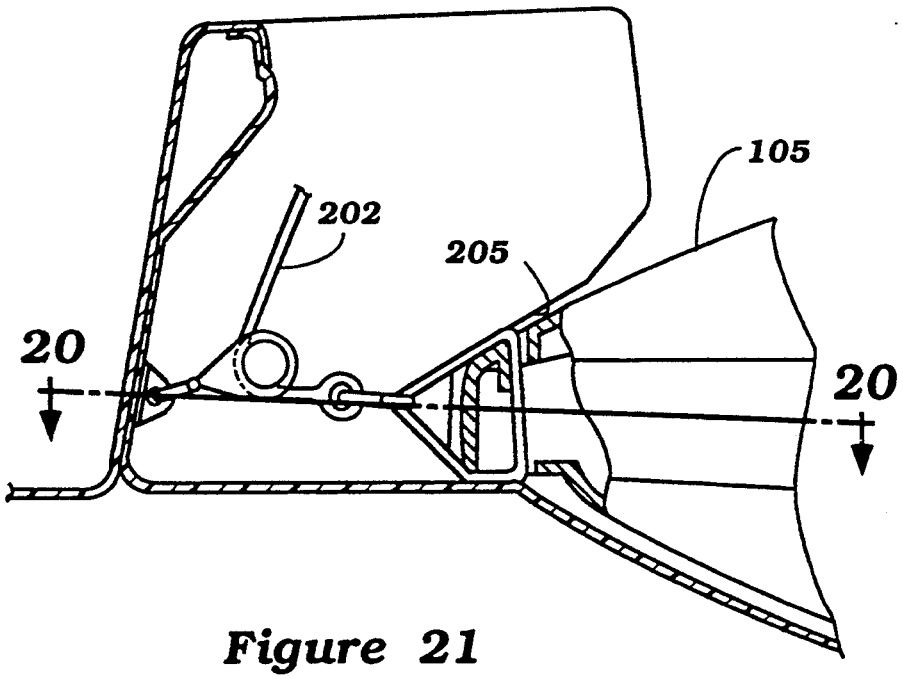
FIG. 21 is an enlarged cross sectional view taken through the front of the berthing area.
Figure 22:
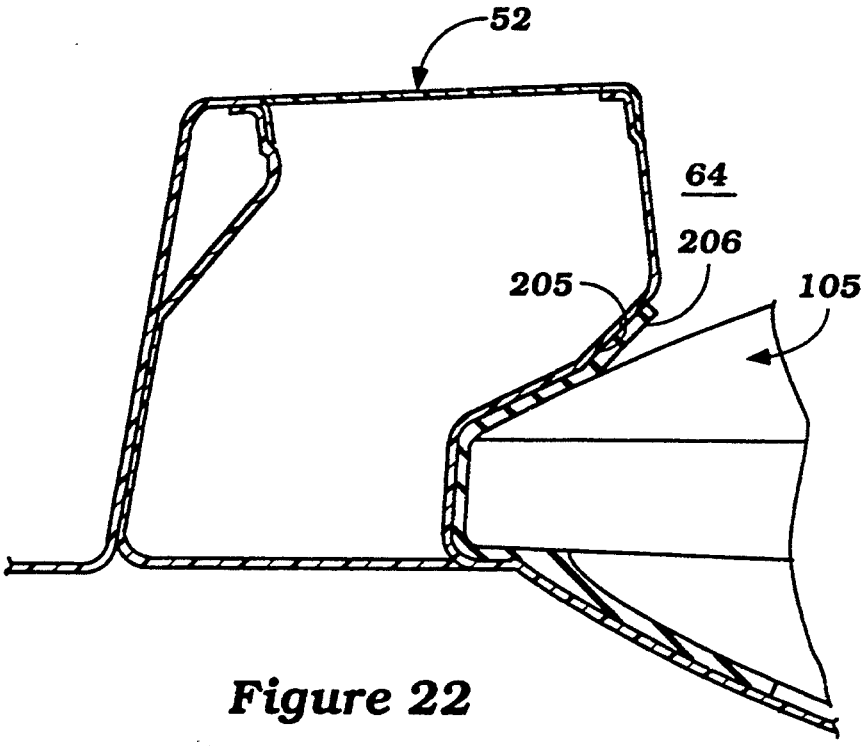
FIG. 22 is a further enlarged cross sectional view, in part similar to FIG. 21.
Figure 23:
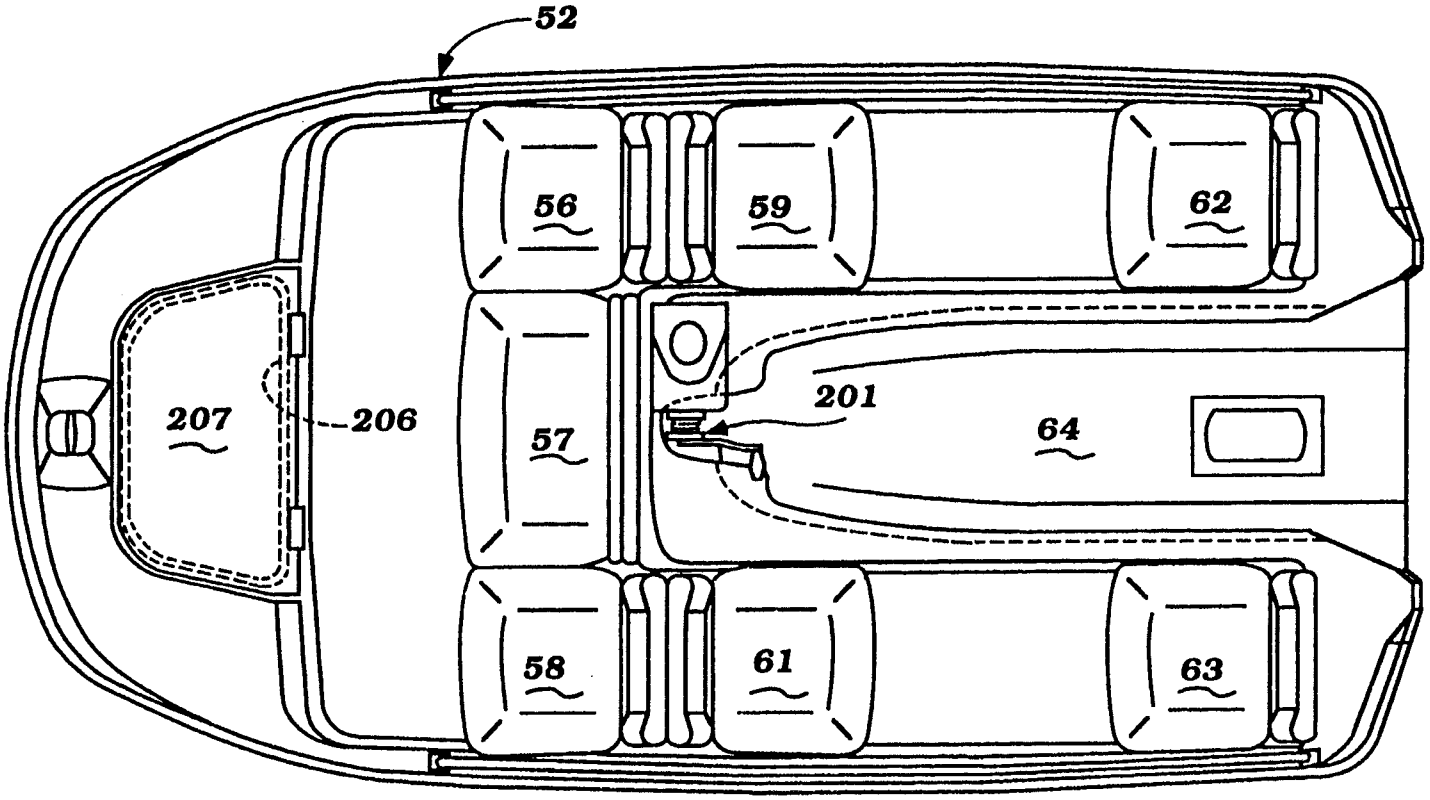
FIG. 23 is a top plan view, in part similar to FIG. 18, and shows the watercraft with the berthing area unoccupied.

The feature which distinguishes this embodiment from those previously described in the provision of a manually operated winch 201 that is positioned at the forward end of the berthing area 64 and which acts on a wire 202 and detachable clamp 203 with a fitting 204 at the forward end of the hull of the small watercraft 105 for drawing the small watercraft 105 into the berthing area 64. The front wall of the berthing area, as shown in FIGS. 21 and 22 is provided with a recess 205 in which a pad 206 may be provided so as to snugly hold the front of the small watercraft 105 in position.

This embodiment also depicts a front storage area 206 that is accessible through a pivotally mounted hatch 207, which construction is shown in FIGS. 1 through 4 but which has not been identified by reference numerals. In all other regards, this embodiment may be considered to be the same as those previously described and, for that reason, further description is believed to be unnecessary.

A watercraft constructed in accordance with another embodiment of the invention is identified generally by the reference numeral 251 and is shown in FIGS. 24 through 31. In many instances, components of the watercraft 251 are the same or function the same as those of the previously described embodiments. Therefore, if any details of the construction of the watercraft 251 are not described in conjunction with the following description, it may be assumed that those details may be of any of the types previously or hereinafter illustrated and described by reference to the other embodiments of the invention. The differences between this embodiment and the other embodiments will be described in most detail.

In this embodiment, the watercraft 251 includes a main hull 252 which is devoid of any propulsion unit of its own. The main hull 252 is provided with a seating area 253 which is generally configured in a U-shape in top plan view as with the previously described embodiments and which lies around a berthing area 254 in which a small watercraft, shown in phantom in some views and identified generally by the reference numeral 255 is adapted to be docked.

Figure 25:
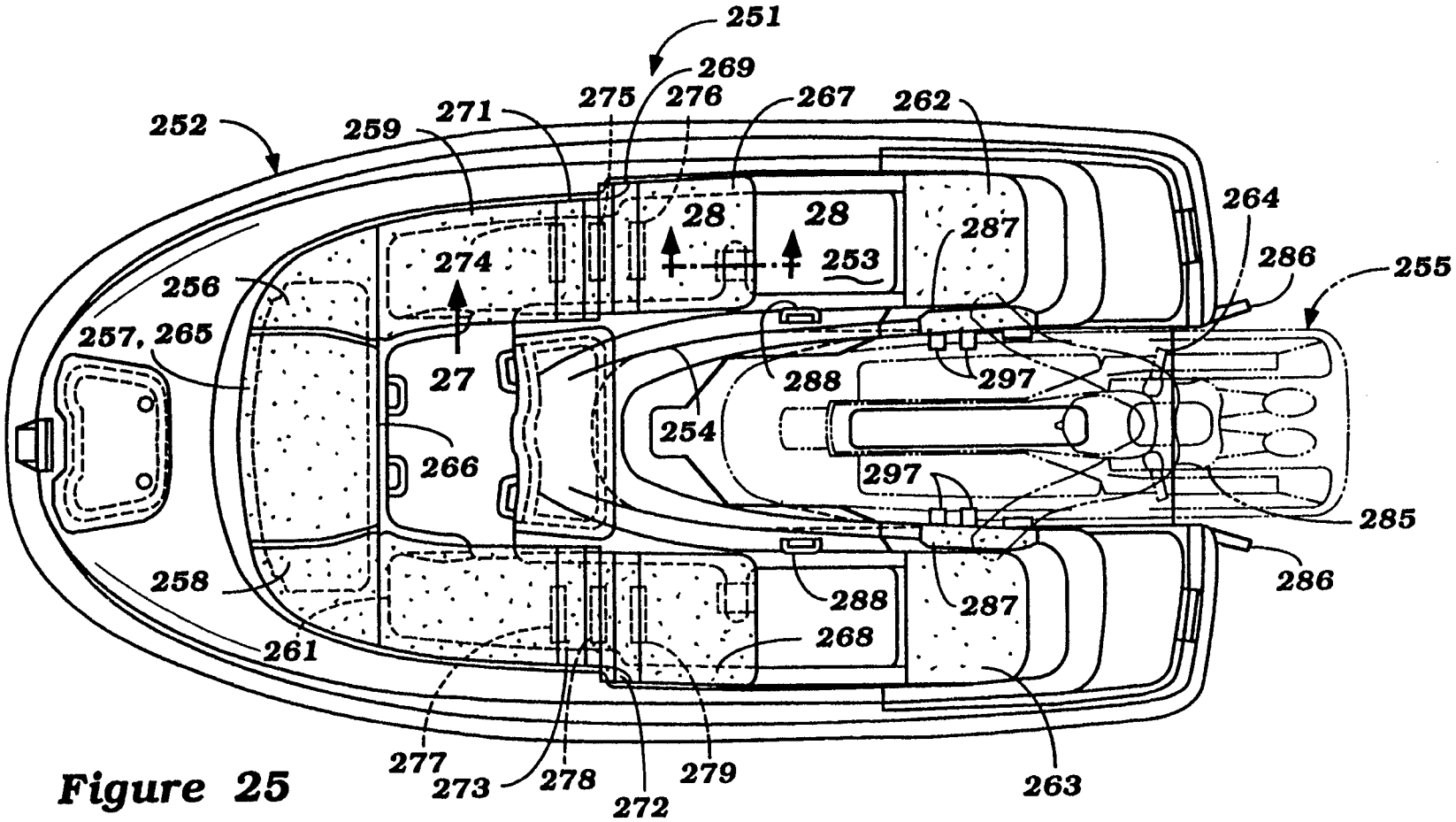
FIG. 25 is a top plan view of this embodiment and shows how the small watercraft may be continued to be moved into the berthing area.
Figure 26:
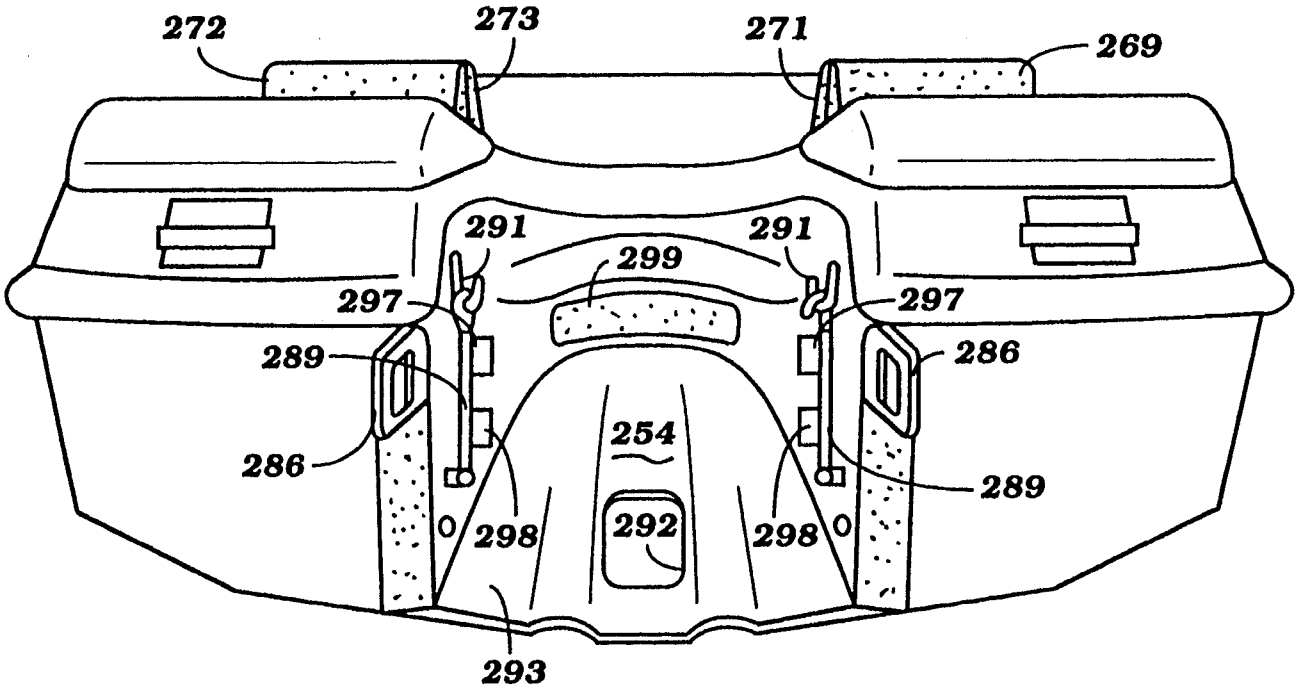
FIG. 26 is a rear elevational view of this embodiment with the small watercraft out of the berthing area.

In this embodiment, the rider's area 253 is provided with a number of relatively rigid fixed seating cushions 256, 257, 258, 259, 261, 262 and 263 disposed as best shown in FIG. 25. The cushions 262 and/or 263 are adapted to accommodate a rider in juxtaposition to the area of the berthing area 254 where the controls 264 of the small watercraft 255 are positioned so as to permit the control of the main hull 252 from the control 264 of the small watercraft 255 when in position in the berthing area 254.

Figure 24:
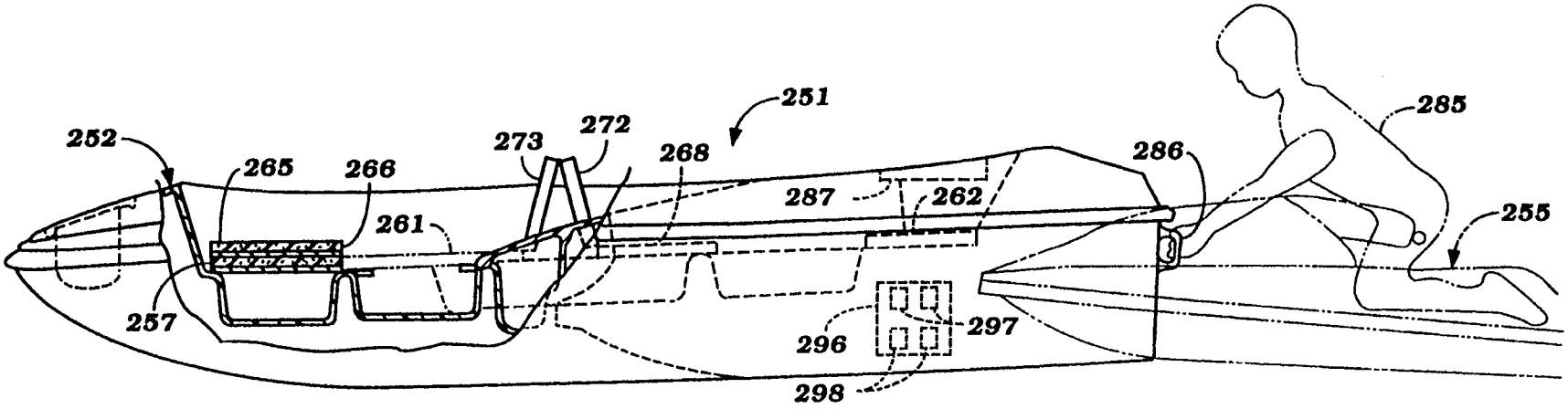
FIG. 24 is a side elevational view, in part similar to FIGS. 1, 5 and 17, and shows a fourth embodiment of the invention, with a portion broken away and showing the entry of the small watercraft into the berthing area in phantom.
Figure 29:
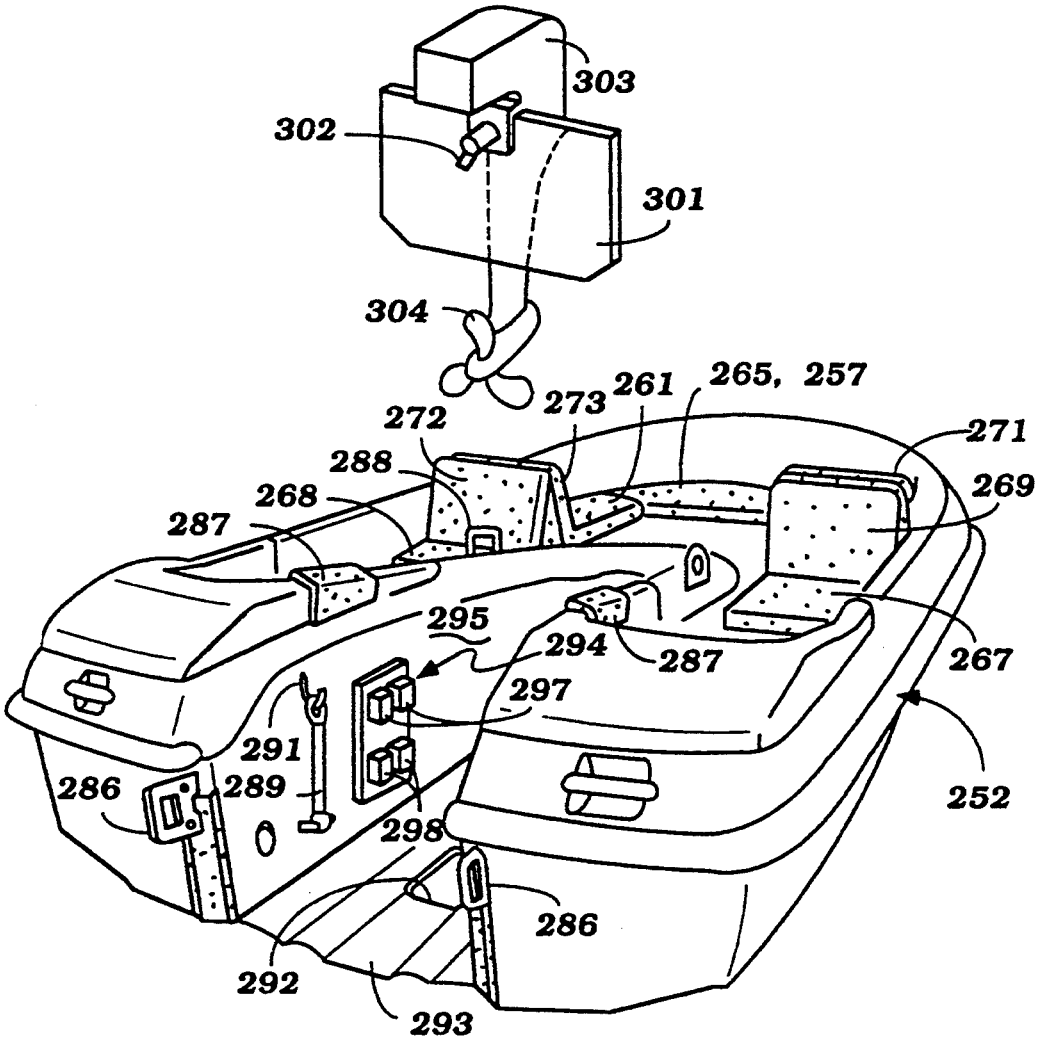
FIG. 29 is a rear perspective view of this embodiment showing how an outboard motor may be employed for propelling the main hull.
Figure 30:
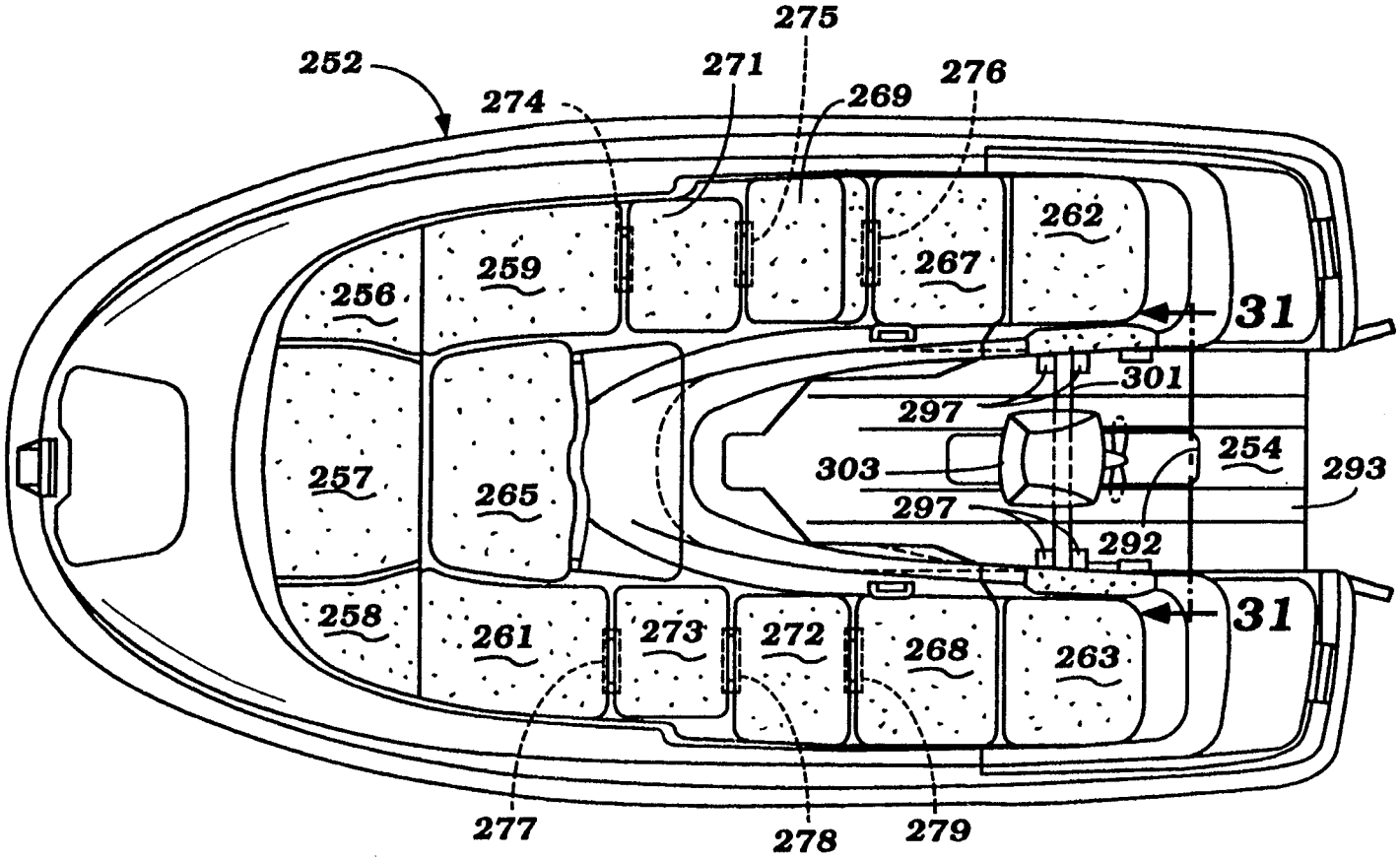
FIG. 30 is a top plan view, in part similar to FIG. 25, and shows the outboard motor in position and the seats folded to provide a different configuration in the seating area.

A foldable cushion 265 is connected to the fixed cushion 257 by a hinge 266 so as to pivoted from a seating position as shown in FIGS. 24, 25 and 29 to a position wherein a larger seating or sleeping area is provided as shown in FIG. 30.

Figure 27:
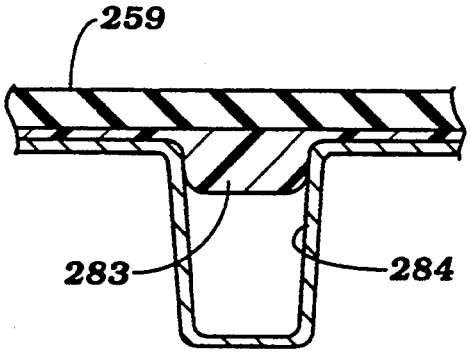
FIG. 27 is an enlarged cross sectional view taken along the line 27—27 of FIG. 25.
Figure 28:
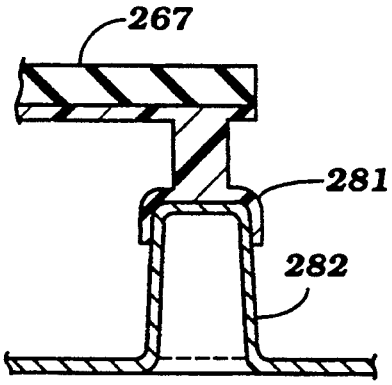
FIG. 28 is a cross sectional view taken along the line 28—28 of FIG. 25.

A pair of further cushions 267 and 268 are connected to the cushions 259 and 206, respectively, by pairs of cushions 269, 271 and 272, 273. The cushion 271 is pivotally connected to the cushion 259 by a hinge 274 while the cushions 271 and 269 are pivotally connected to each other by a hinge 275. The cushion 269 is pivotally connected to the cushion 267 by a hinge 276. In a similar manner, the cushion 273 is connected to the cushion 265 by a hinge 277;, the cushion 272 is pivotally connected to the cushion 273 by a hinge 278 and the cushion 272 is connected to the cushion 268 by a hinge 279. The cushions 267 and 268 may be moved forwardly and the cushions 269, 271 and 272, 273 pivoted to an upright position to provide seat backs as also shown in FIGS. 24, 25, 26 and 29 so as to provide an erect seating area. The seat cushions 267 and 268 are held against rearward movement when in this position by means of a flange portion 281 formed on the underside thereof that cooperates with a raised embossment 282 formed in the hull 252 so as to maintain this seating configuration (FIG. 27). The seat cushions 267 and 268 may be moved rearwardly by raising the portions 281 from the portions 282 and sliding them rearwardly to the position shown in FIG. 30 so as to provide a lying area or kneeling area along the full area of the rider's compartment 253.

There is also provided an interlocking mechanism comprised of a pair of projections 283 (FIG. 28) formed on the underside of the cushions 259 and 261 that are received within slots formed by channels 284 of the hull 252 so as to provide the seat assemblage from sliding rearwardly when it is in the position shown in FIG. 30. In addition, the contact of the cushions 267 and 268 with the cushions 262 and 263 will preclude such rearward movement.

This embodiment also incorporates an arrangement so as to permit a rider, shown in phantom at 285 in certain of the figures, seated or kneeling upon the small watercraft 255 to draw the small watercraft 255 into the berthing area 254. This mechanism includes a pair of rear mounted grab handles 286 that are mounted on the transom of the main hull 252 on opposite sides of the berthing area 254. As the small watercraft 255 approaches the berthing area 254, the rider 285 may easily grasp the handles 286 as shown in FIG. 24 and pull the small watercraft 255 forwardly into the berthing area 254. As the small watercraft 255 moves into the berthing area 254, the operator 285 may then grasp a pair of resilient but textured skid pads 287 positioned on opposite sides of the berthing area 254 toward its rear one third portion and further draw the small watercraft 255 into the berthing area 254. A pair of forward grab handles 288 are also provided so that the rider may finish the berthing operation.

A pair of hold downstraps 289 are mounted on opposite sides of the berthing area 254 and are normally held in storage positions by suitable clips 291. Once the small watercraft 255 is completely in the berthing area 254, the straps 289 may be connected to each other by a hook and loop fastener at the ends thereof so as to hold the small watercraft 255 in position with its water inlet opening in registry with a water inlet opening 92 formed in the lower wall 293 of the main hull 252 which forms the berthing area. Like the previously described embodiments, the opening 292 is substantially longer than the water inlet opening of the jet propulsion unit of the small watercraft so as to avoid turbulence in the water intake thereto.

A pair of combined guide and pad assemblies, indicated generally by the reference numeral 294 are affixed to each of the side walls 295 of the main hull 252 which defines the berthing area 254. These assemblies 294 are comprised of relatively rigid backing plates 296 from which a pair of spaced apart upper lugs 297 and spaced apart lower lugs 298 extend. The lugs 297 and 298 are formed from a elastomeric material and define a horizontally extending gap that has a height sufficient so as to clear the gunnels of the small watercraft 255 so as to assist in locating it in the berthing area 254. The lugs 297 and 298 also define a vertically extending gap, the purpose of which will be described later.

A forwardly extending pad 299 extends across the front wall of the berthing area 254 so as to further cushion and locate the small watercraft 255 in the berthing area 254.

Figure 31:
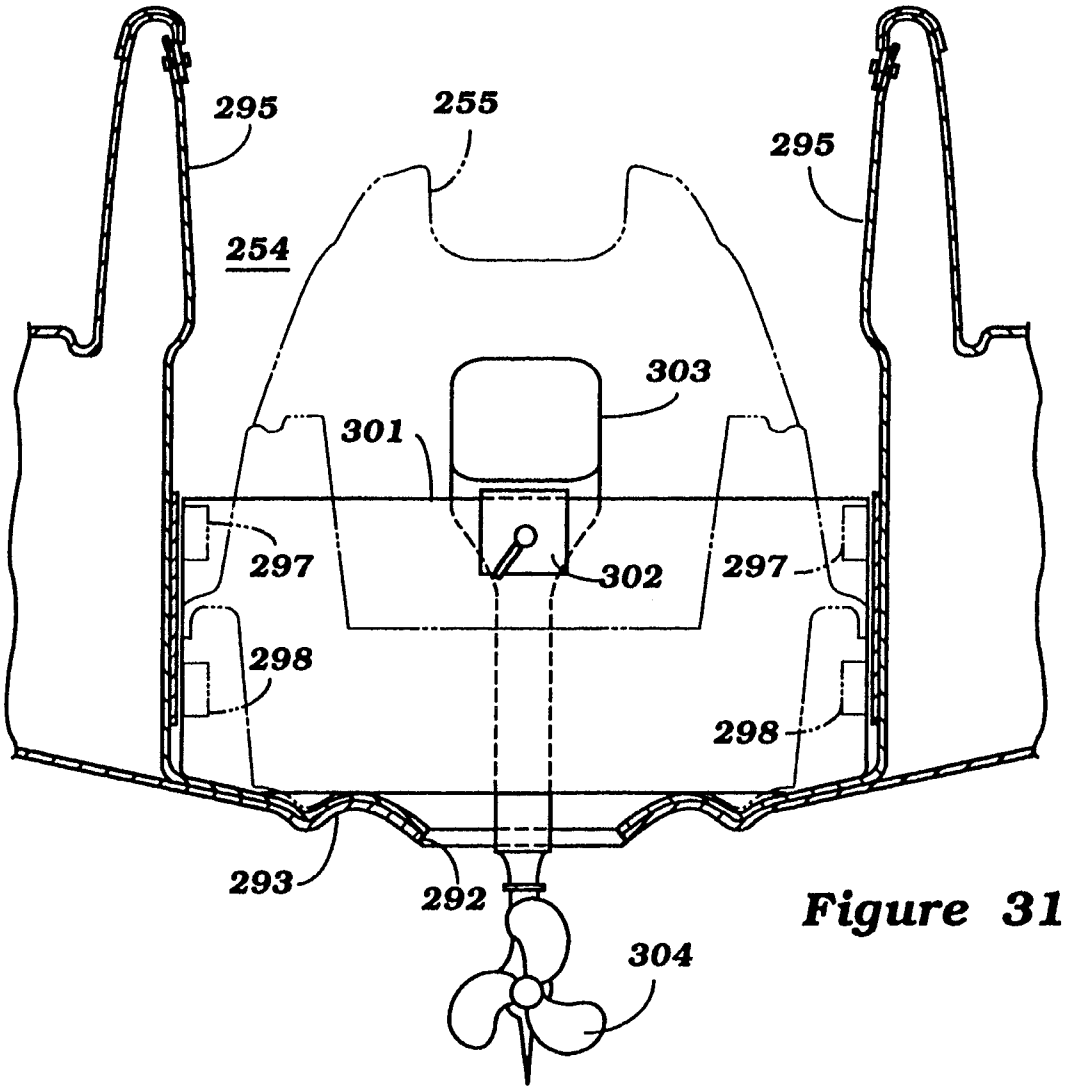
FIG. 31 is a cross sectional view taken along the line 31—31 of FIG. 30 showing the outboard motor in position in solid lines and the small watercraft in position in phantom lines.
Figure 32:
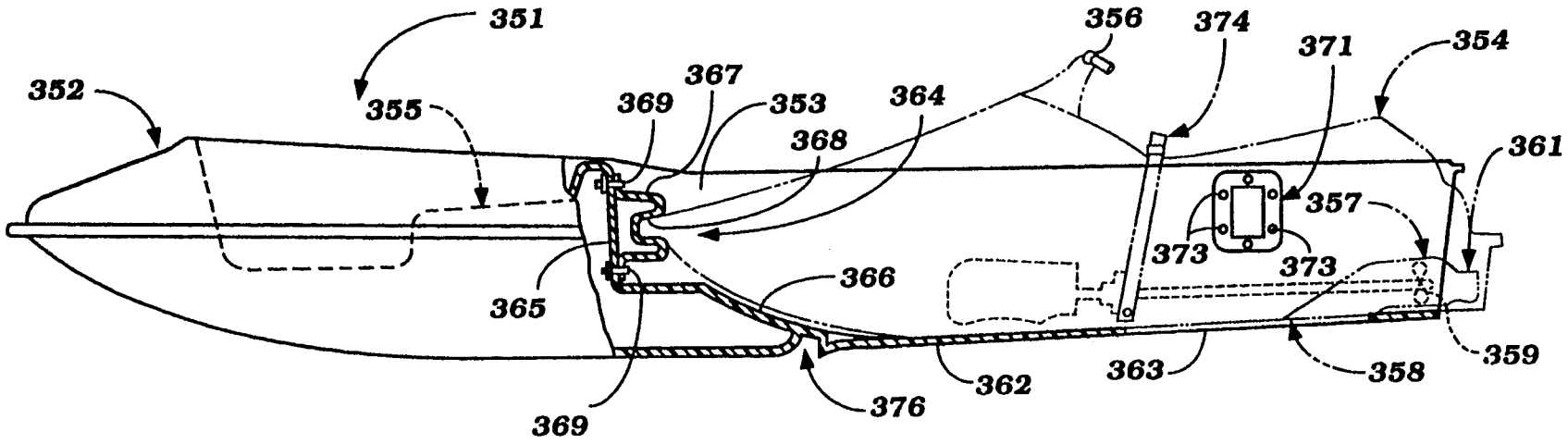
FIG. 32 is a side elevational, in part similar to FIGS. 1, 5, 17 and 24 showing a fifth embodiment of the invention, with a portion broken away.
Figure 33:
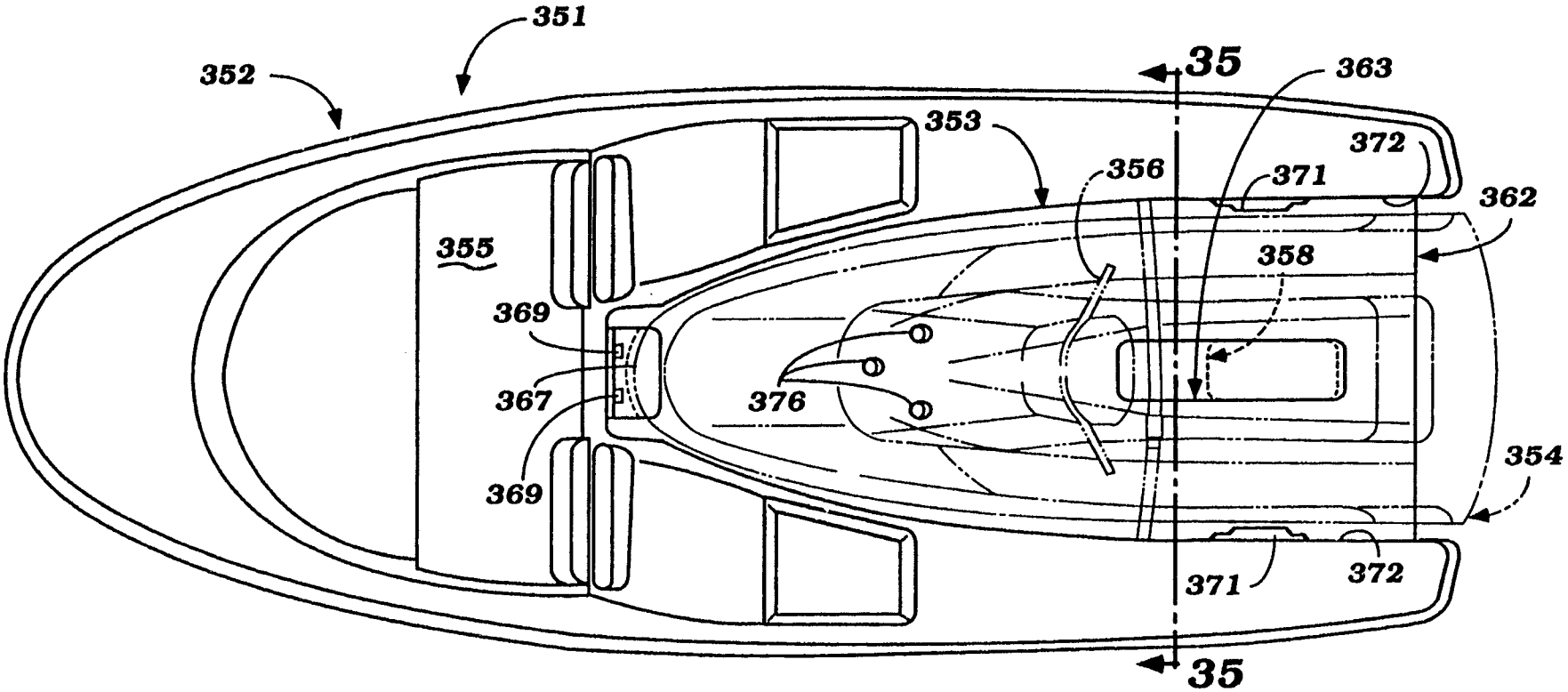
FIG. 33 is a top plan view of this embodiment.
Figure 34:
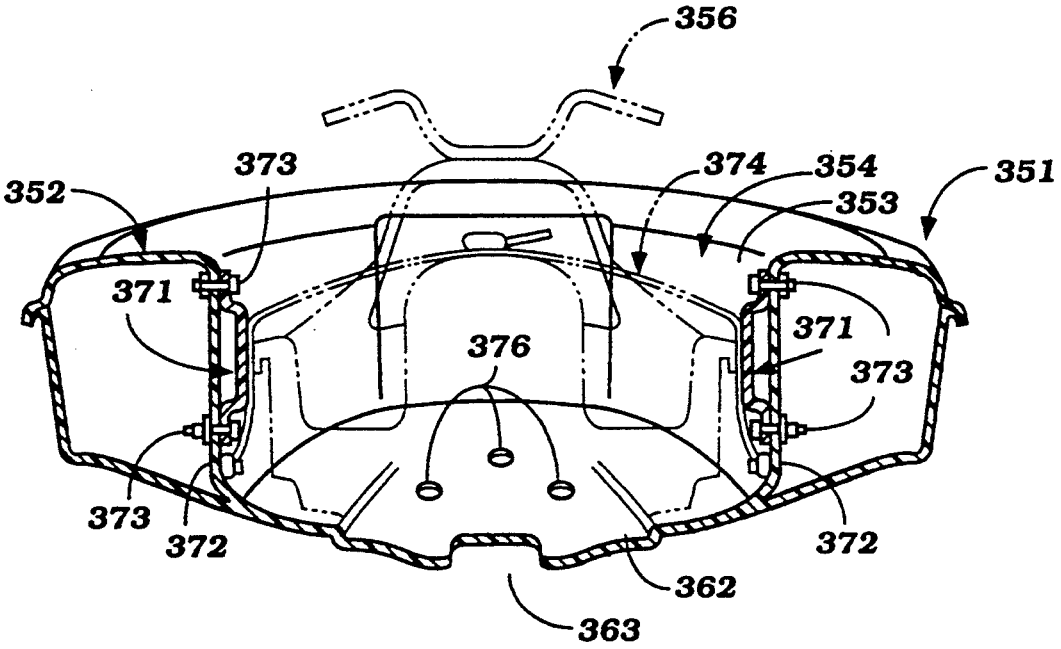
FIG. 34 is a partially perspective, cross sectional view taken generally along the line 34—34 of FIG. 33.
Figure 35:
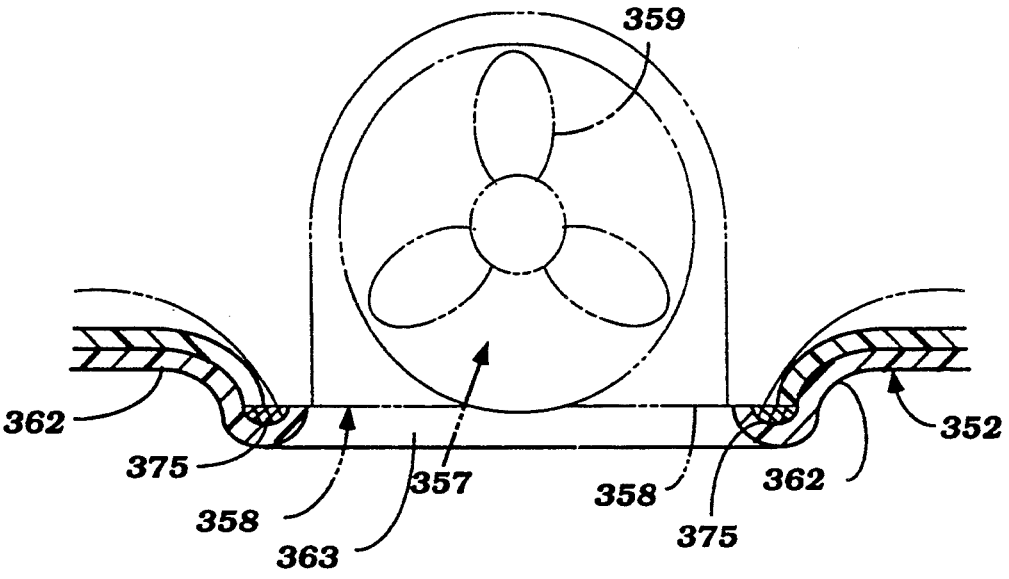
FIG. 35 is a further enlarged cross sectional view taken along the same plane as FIG. 34 but shows the small watercraft in phantom for orientation purposes.

As may also be seen in the phantom line view of FIG. 31, the lower hull portion of the small watercraft 255 is configured so as to provide stabilization and the lower wall 293 of the main hull 252 is also so configured so as to assist in the location of the small watercraft 255 and to assist its support in the berthing area.

Like the embodiments of FIGS. 1 through 4 and 5 through 15, the small watercraft 105 has its deck positioned so that a rider standing on it and operating the small watercraft 105 in his normal fashion may operate the combined watercraft 251 since he will be able to see over the head of a seated passenger on the forward center seat 57.

It has been noted and has is true with all other embodiments of the invention, the main hull 252 is devoid of its own propulsion unit. In each embodiment, the main hull is powered by the small watercraft when positioned in the respective berthing area. There may be times when it is desirable to propel the main hull of the watercraft without having small watercraft in the berthing area and FIGS. 29 through 31 show how this can be accomplished, with this particular embodiment. It is to be understood, however, that the description of the following structure may be embodied with any of the embodiments previously described and also with that which will be subsequently described.

It has been noted that the lugs 297 and 298 define a vertically extending gap. As may be seen in FIGS. 29, 30 and 31, this gap is aligned generally with the opening 292 in the lower wall 293 of the berthing area of the main hull. A mounting plate 301 may easily be slid into this gap and held in position by the pads 297 and 298. This mounting plate 301 may be notched or otherwise configured so as to permit the clamping device 302 of any conventional type of outboard motor 303 to be mounted thereupon. When so mounted, a propeller 304 of the outboard motor 303 will depend through the opening 292 and can be employed to propel the main hull 252. It should be noted that this positioning is also adjacent the rear seats 262 and 263 so that the outboard motor 303 may be controlled from either of these seats as may the operation of the main hull 252.

FIGS. 32 through 35 show another embodiment of the invention which is generally similar to the previously described embodiments and, for that reason, where components are the same or substantially the same as any of the embodiments previously described they will not be described in further detail. Also, it should be understood that the constructions which will be described in conjunction with this embodiment may also be employed in conjunction with the previously described embodiments.

A watercraft constructed in accordance with this embodiment is identified generally by the reference numeral 351 and like the previously described embodiments includes a main hull 352 that defines a berthing area 353. A small watercraft, identified generally by the reference numeral 354 is adapted to be positioned in the berthing area 353 in a manner which will be described.

The main hull 352 defines a seating or passenger area 355 which, unlike the previously described embodiments, although having a generally U-shape does not extend back far enough to permit the controls 356 of the small watercraft 354 to be operated from the seating area 355. It is to be understood, however, that the features of this embodiment may be incorporated with main hulls as previously described so that the controls 356 can be operated from the seating area. Also, as has been described in conjunction with certain of the previously described embodiments, the total watercraft 259 may be operated by an operator seated or standing on the small watercraft 354 within the berthing area 352.

In this embodiment, like those previously described, the small watercraft 354 is powered by a jet propulsion unit 356 having a downwardly facing water inlet opening 358 through which water is drawn by an impeller 359 and discharged through a discharge nozzle 361 upon which a steering nozzle of a known type may be mounted.

A lower wall 362 of the main hull 352 which defines the berthing area 353 is provided with an elongated opening 363 through which water may be drawn for the jet propulsion unit water inlet opening 358. Like those embodiments previously described, the lower wall opening 353 extends forwardly a substantial distance beyond the water inlet opening 358 of the small watercraft 354 when the small watercraft 354 is in position. This permits water to be drawn into the water inlet opening 358 without any turbulence caused by the step between the lower portion of the hull of the main watercraft and that of the jet propulsion unit of the small watercraft 354.

A replaceable pad assembly, to be described, is provided in the berthing area 353 and is removably supported by the main hull 352 so as to locate and accommodate the small watercraft 354 in this berthing area 353. By employing a replaceable pad assembly, not only may the pads be replaced as worn but also different configuration pads may be incorporated so as to accommodate small watercraft having different configurations.

The replaceable pad assembly includes a front pad, indicated generally by the reference numeral 364 that is mounted on a vertically extending wall 365 of the main hull 352 which is formed forwardly of a curved wall 366 that merges into the lower wall 362. This pad assembly 364 includes an elastic pad 367 that has a recess 368 that is adapted to receive the bow of the small watercraft 354 and hold it vertically in position. Threaded fasteners 369 affix the pad 364 to the hull wall 365.

In addition, the pad assembly includes a pair of side pads 371 which are affixed to side walls 372 of the main hull 352 that defines the berthing area 354. These pads 371 include elastomeric portions that are affixed to the walls 372 by threaded fasteners 373.

In addition to the pads 364 and 371, the small watercraft 354 is held in the berthing area 353 by a hold down strap 374. The hold down strap 374 insures that the water inlet opening 358 of the jet propulsion unit of the small watercraft 354 will be in good sealing relationship around the opening 363 of the lower wall 362. As has been previously noted, the area around the opening 358 of the small watercraft hull is substantially flat and has may be seen in FIG. 35, an elastic seal 375 is provided in the main hull lower wall 362 so as to assist in this sealing. It should be noted and as has been previously described, the lower portion of the hull of the small watercraft 354 may not be completely complimentary to the shape of the lower wall 362 although general conformity is achieved. To avoid the intrusion or entrapment of air into such voids, the lower wall 362 of the main watercraft 352 is provided with a plurality of water relief holes 376 which will permit water to enter under the action of the jet propulsion unit 357 and will avoid air entrapment and lost of efficiency of the jet propulsion unit 357 of the small watercraft when in position. As a result, these water holes 376 will avoid air cavitation and air entrapment and improve the efficiency of the operation.

In this embodiment, like the previously described embodiments, a rider of the small watercraft 354 may operate the combined watercraft 351 while still on the small watercraft 354. The operating position in this embodiment, is the same as that of FIGS. 1 through 5. That is, in this embodiment the operator of the small watercraft is seated upon the seat and this seat is higher than the center of the front seat 355 so the rider of the small watercraft 354 may operate the combined watercraft 351 even if there is a passenger seated ahead of him because his head, assuming he has the same stature as the forward passenger, will be above that of the forward passenger.

It should be readily apparent from the foregoing description of the preferred embodiments of the invention that the objects set forth are well met. Of course, the foregoing description is that of preferred embodiments of the invention and various changes and modifications may be made without departing from the spirit and scope of the invention, as defined by the appended claims.

I claim:

1. A watercraft comprised of a main hull defining a berthing area open at the rear end thereof for receiving a smaller watercraft a jet propulsion unit propulsion device mounted in the hull of the smaller watercraft and which includes a downwardly facing water inlet opening formed therein, said berthing area being defined by an opening in the transom of said main hull, a front wall adapted to be engaged by the bow of the smaller watercraft, a pair of facing side walls and a lower wall having a water inlet opening for permitting water to flow from the body of water in which said watercraft is operating into said smaller watercraft water inlet opening, hand grip extending along the opposite sides of said berthing area and carried by said main hull for permitting a rider on said smaller watercraft to draw said smaller watercraft into said berthing area, hold down means carried by said main hull for retaining the portion of the hull of the smaller watercraft defining the water inlet opening into contact with the portion of said lower wall of said main hull defining said water inlet opening, said hold down means comprising a combined ladder and hold down assembly supported for movement by said main hull at the end of the berthing area between a lowered position in which the smaller watercraft may enter said berthing area and in which boarding of said main hull from the body of water in which said main hull is operating is facilitated and a raised position for retaining said smaller watercraft in said berthing area.

2. A watercraft as set forth in claim 1 wherein the combined ladder and hold down assembly is supported for pivotal movement.

3. A watercraft as set forth in claim 2 wherein the combined ladder and hold down assembly is supported for pivotal movement about a transversely extending pivot axis and extends across the rear of the berthing area.

4. A watercraft as set forth in claim 3 wherein the combined ladder and hold down assembly is disposed to afford a seating device for an operator on the small watercraft when in the berthing area.

5. A watercraft comprised of a main hull defining a berthing area and a passengers' compartment area adapted to accommodate a plurality of passengers, said berthing area being defined by a front wall and a pair of side walls formed separately from but affixed to said hull, said front and side walls having lower portions which extend in a generally horizontal direction to provide a lower surface for supporting a smaller watercraft received within said berthing area, said main hull having its lower walls extending in overlapping relationship to said horizontal wall portions of said berthing area so as to provide a double thickness reinforced area on the lower side of said berthing area upon which said smaller watercraft is supported, said main hull being devoid of any propulsion device, and said berthing area being sized to accommodate a smaller watercraft receiving therein and having a propulsion device for propelling said main hull.

6. A watercraft as set forth in claim 5 wherein the smaller watercraft is propelled by a jet propulsion unit having a downwardly facing water inlet opening, said lower wall of said berthing area and said lower wall of said hull defining an opening, in their overlapping areas, adapted to register with the water inlet opening of the smaller watercraft for drawing of water therethrough when said smaller watercraft is positioned within said berthing area.

7. A watercraft as set forth in claim 5 wherein the lower walls of the berthing area and the main hull in the area underlying the berthing area are configured to be complimentary to the configuration of the hull of the smaller watercraft.

8. A watercraft as set forth in claim 7 wherein the smaller watercraft is propelled by a jet propulsion unit having a downwardly facing water inlet opening, said lower wall of said berthing area and said lower wall of said hull defining an opening, in their overlapping areas, adapted to register with the water inlet opening of the smaller watercraft for drawing of water therethrough when said smaller watercraft is positioned within said berthing area.

9. A watercraft as set forth in claim 5 wherein the passenger area of the main hull includes at least one seat positioned forwardly of the berthing area and wherein a rider seated on said seat in said passenger area will have his head below the head of a rider on the small watercraft when received in the berthing area and in the rider's normal operating position.

10. A watercraft as set forth in claim 9 wherein the small watercraft has a seat for its rider and the small watercraft seat is higher than the seat in the passengers' area when the small watercraft is received in the berthing area.

11. A watercraft as set forth in claim 9 wherein the small watercraft has a deck on which a rider stands for operating the small watercraft.

12. A watercraft comprised of a main hull defining a berthing area adapted to receive a smaller watercraft and a passengers' compartment extending at least in part across the front of said berthing area, at least one seat positioned in said passengers' compartment and forwardly of said berthing area, said berthing area being configured so that a small watercraft positioned therein and operated by a rider will have the head of the rider positioned above the head of a person of similar stature seated in said seat.

13. A watercraft as set forth in claim 12 wherein the small watercraft has a seat for its rider and the small watercraft seat is higher than the seat in the passengers' area when the small watercraft is received in the berthing area.

14. A watercraft as set forth in claim 12 wherein the small watercraft has a deck on which a rider stands for operating the small watercraft.

15. A watercraft as set forth in claim 12 wherein the main hull is devoid of any propulsion device and the small watercraft carries a propulsion device which operative for propelling the main hull when said small watercraft is received within said berthing area.

16. A watercraft as set forth in claim 15 wherein the smaller watercraft is propelled by a jet propulsion unit having a downwardly facing water inlet opening, said lower wall of said berthing area and said lower wall of said hull defining an opening, in their overlapping areas, adapted to register with the water inlet opening of the smaller watercraft for drawing of water therethrough when said smaller watercraft is positioned within said berthing area.

17. A watercraft as set forth in claim 15 further including control means carried by the small watercraft for controlling its propulsion device, and said passengers' compartment of said main hull further defining an area in proximity to said smaller watercraft controls for operation thereof by a rider in said passengers' compartment of said main hull.

* * * * *